US008090279B2

(12) United States Patent
Ishikuro

(10) Patent No.: US 8,090,279 B2
(45) Date of Patent: Jan. 3, 2012

(54) IMAGE FORMING APPARATUS HAVING CONTROL UNIT

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 363 days.

(21) Appl. No.: 11/703,775

(22) Filed: Feb. 8, 2007

(65) Prior Publication Data

US 2007/0212083 A1 Sep. 13, 2007

(30) Foreign Application Priority Data

Mar. 10, 2006 (JP) ..... 2006-066213

(51) Int. Cl.
*G03G 15/00* (2006.01)
*G03G 15/20* (2006.01)

(52) U.S. Cl. ..... 399/44; 399/69

(58) Field of Classification Search ..... 399/9, 44, 399/53, 69, 94, 167, 43, 67, 68
See application file for complete search history.

(56) References Cited

U.S. PATENT DOCUMENTS 5,539,510 A * 7/1996 Yamashiro et al. ..... 399/9
6,389,247 B1 * 5/2002 Chung ..... 399/69
6,516,166 B2 * 2/2003 Sakakibara et al. ..... 399/69
2004/0037576 A1 * 2/2004 Ashikawa ..... 399/44
2005/0095023 A1 * 5/2005 Kyung et al. ..... 399/44
2005/0141920 A1 * 6/2005 Sato et al. ..... 399/167
2005/0254844 A1 * 11/2005 Park ..... 399/44
2006/0013605 A1 * 1/2006 Tanaka ..... 399/53
2006/0051117 A1 * 3/2006 Nishida ..... 399/69
2006/0051124 A1 * 3/2006 Oka ..... 399/94
2006/0204258 A1 * 9/2006 Yamane ..... 399/44

FOREIGN PATENT DOCUMENTS

JP 2004-309535 11/2004

* cited by examiner

*Primary Examiner* — David Gray
*Assistant Examiner* — Billy J Lactaoen
(74) *Attorney, Agent, or Firm* — Kubotera & Associates, LLC

(57) ABSTRACT

An image forming apparatus includes an image supporting member; a developer supporting member for attaching developer to the image supporting member to form a developer image; a transfer unit for transferring the developer image to a recording medium; a driving unit for driving at least one of the image supporting member, the developer supporting member, and the transfer unit; an external temperature detection unit for detecting an environmental temperature outside the image forming apparatus; and a control unit for setting a driving speed of the driving unit according to the environmental temperature.

20 Claims, 16 Drawing Sheets

| Te | V | T |
|---|---|---|
| Tc1 > Te | V0 | T0 |
| Tc1 ≤ Te < Tc2 | V1 | T1 |
| Tc2 ≤ Te | V2 | T2 |

FIG. 9

| Ti | |
|---|---|
| Tc0 > Ti | |
| Tc0 ≤ Ti | |

Printing operation

Continuous printing

Intermittent printing

FIG. 10

IMAGE FORMING APPARATUS HAVING CONTROL UNIT

BACKGROUND OF THE INVENTION AND RELATED ART STATEMENT

The present invention relates to an image forming apparatus.

In a conventional image forming apparatus such as a printer, a copier, and a facsimile, an image is formed through the following process. First, a charge roller charges a surface of a photosensitive drum. An exposure device such as an LED head exposes the surface of the photosensitive drum to form a static latent image or a latent image thereon. A developing roller attaches a thin layer of toner to the static latent image to form a toner image. A transfer roller transfers the toner image to a sheet or a recording medium, thereby printing or forming an image on the recording medium. An image forming unit (developing device) is formed of the photosensitive drum, the charge roller, the developing roller, and the likes.

After transferring the toner image, the sheet is transported to a fixing device, so that the fixing device fixes the toner image to the sheet.

In the conventional image forming apparatus described above, an image is formed on the sheet under a specific condition such as a print speed, a fixing temperature, and the likes corresponding to the sheet. A temperature sensor is disposed adjacent to the photosensitive drum for detecting a temperature inside the image forming apparatus. When the temperature sensor detects a temperature higher than a specific temperature, the image forming apparatus temporarily stops the printing operation and performs an intermittent printing operation. Accordingly, it is possible to prevent a temperature inside the image forming apparatus from rising higher than the specific temperature, so that flow characteristic of toner is not deteriorated or the photosensitive drum is not charged improperly (refer to Patent Reference).

Patent Reference: Japanese Patent Publication No. 2004-309535

In the conventional image forming apparatus described above, when the temperature sensor detects a temperature below the specific temperature, the image forming apparatus performs the printing operation normally. However, when the image forming apparatus is installed in a relatively high temperature environment, discharging efficiency of heat of the image forming apparatus is lowered. Accordingly, a temperature inside the image forming apparatus may rise above the specific temperature rather quickly even in a normal condition.

As described above, the conventional image forming apparatus is configured to perform the intermittent printing operation until the temperature inside the intermittent printing operation becomes below the specific temperature. However, when the image forming apparatus is installed in a relatively high temperature environment, in which discharging efficiency of heat of the image forming apparatus is lowered, it may be difficult to maintain the temperature below the specific temperature even in the intermittent printing operation. As a result, the image forming apparatus may stay in a relatively high temperature environment for a long period of time, thereby deteriorating toner.

In view of the problems described above, an object of the present invention is to provide an image forming apparatus, in which it is possible to prevent toner from deteriorating due to exposure to a high temperature for a long period of time.

Further objects and advantages of the invention will be apparent from the following description of the invention.

SUMMARY OF THE INVENTION

In order to attain the objects described above, according to the present invention, an image forming apparatus includes an image supporting member; a developer supporting member for attaching developer to the image supporting member to form a developer image; a transfer unit for transferring the developer image to a recording medium; a driving unit for driving at least one of the image supporting member, the developer supporting member, and the transfer unit; an external temperature detection unit for detecting an environmental temperature outside the image forming apparatus; and a control unit for setting a driving speed of the driving unit according to the environmental temperature.

In the present invention, the image forming apparatus includes the image supporting member; the developer supporting member for attaching developer to the image supporting member to form the developer image; the transfer unit for transferring the developer image to the medium; the driving unit for driving at least one of the image supporting member, the developer supporting member, and the transfer unit; the external temperature detection unit for detecting the environmental temperature outside the image forming apparatus; and the control unit for setting the driving speed of the driving unit according to the environmental temperature.

In particular, the external temperature detection unit detects the environmental temperature outside the image forming apparatus; and the control unit sets the driving speed of the driving unit according to the environmental temperature. Accordingly, it is possible to reduce frictional heat. As a result, it is possible to maintain a temperature of developer below a specific temperature. Therefore, it is possible to prevent deterioration of developer, lowered flow characteristic of developer, and improper charging.

Further, in the present invention, it is possible to reduce heat conducted to a sheet through lowering the driving speed, thereby making it possible to reduce a fixing temperature. Further, it is possible to prevent the driving unit from generating excessive heat. Accordingly, even when a plurality of images is formed sequentially, it is possible to prevent a temperature inside the image forming apparatus from rising.

BRIEF DESCRIPTION OF THE DRAWINGS

FIG. 9 is a schematic view showing a control table of an external thermistor according to the first embodiment of the present invention;

FIG. 10 is a schematic view showing a control table of an internal thermistor according to the first embodiment of the present invention;

DETAILED DESCRIPTION OF PREFERRED EMBODIMENTS

Hereunder, embodiments of the present invention will be explained with reference to the accompanying drawings. In the embodiments, a color printer will be explained as an image forming apparatus for forming an image.

First Embodiment

Figure 2:
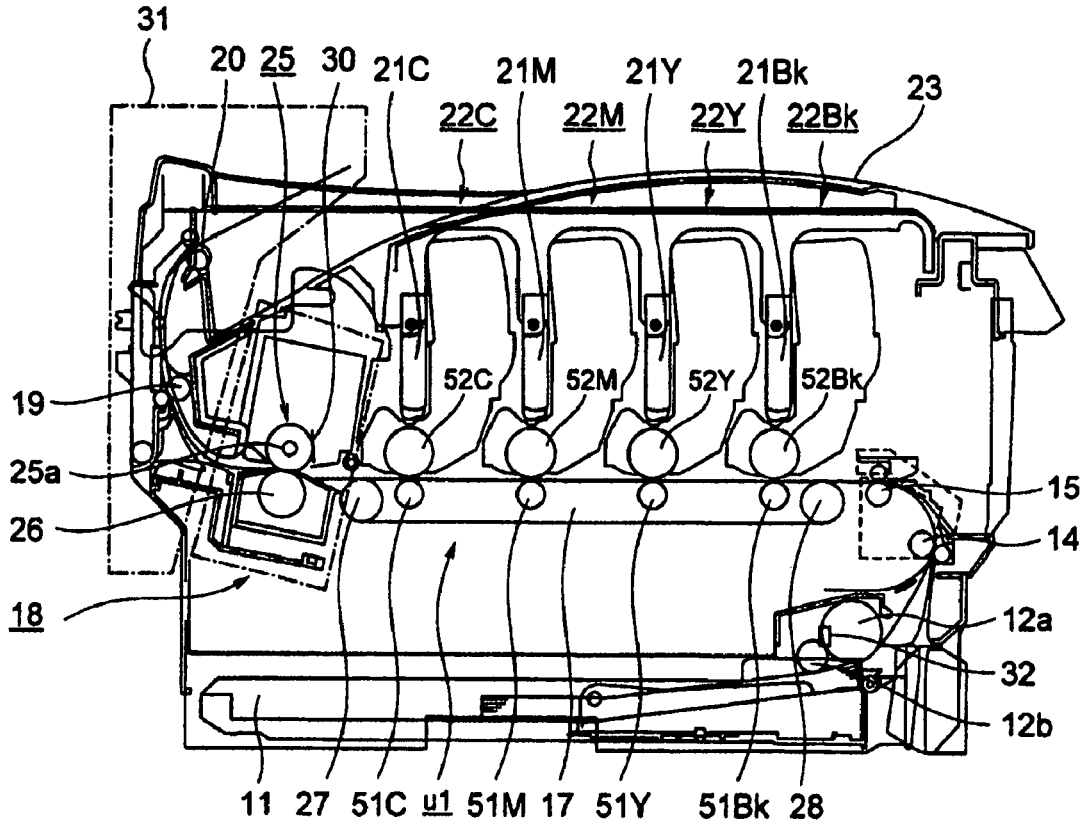
FIG. 2 is a schematic view showing a printer according to the first embodiment of the present invention.

A first embodiment of the present invention will be explained. FIG. 2 is a schematic view showing a printer according to the first embodiment of the present invention.

As shown in FIG. 2, a sheet supply cassette 11 is disposed at a lower portion of the printer as a recording medium storage portion for storing sheets (not shown) as recording media. A sheet supply mechanism is disposed adjacent to the sheet supply cassette 11 for separating and supplying the sheet one by one.

The sheet supply mechanism includes sheet supply rollers 12*a* and 12*b*. After being supplied with the sheet supply mechanism, the sheet is transported to a transport roller 14 disposed at an upper portion, and further to a transport roller 15. Afterward, a transport belt 17 as a transport member or a first transfer member is driven to rotate with a belt motor (described later) as a driving unit for belt transportation. Accordingly, the transport belt 17 transports the sheet further, so that the sheet passes through between a transfer unit u1 as a transfer device and image forming units 22Bk, 22Y, 22M, and 22C.

In the embodiment, the transfer unit u1 and the image forming units 22Bk, 22Y, 22M, and 22C constitute an image forming device for forming images in black, yellow, cyan, and magenta.

The transfer unit u1 includes a drive roller 27; a belt idle roller 28; the transfer belt 17 placed between the drive roller 27 and the belt idle roller 28; and transfer rollers 51Bk, 51Y, 51M, and 51C as transfer members respectively facing photosensitive drums 52Bk, 52Y, 52M, and 52C as image supporting members of the image forming units 22Bk, 22Y, 22M, and 22C with the transport belt 17 inbetween. Note that the belt idle roller 28 applies tension to the transport belt 17 not to be loose.

Each of the transfer rollers 51Bk, 51Y, 51M, and 51C transfers a toner image or a developer image in each color formed with the photosensitive drums 52Bk, 52Y, 52M, and 52C in the image forming units 22Bk, 22Y, 22M, and 22C to the sheet, thereby forming toner images in colors.

Afterward, the sheet is transported to a fixing device 18, so that the fixing device 18 fixes the toner images in colors to the sheet, thereby forming a color image. After being discharged from the fixing device 18, the sheet is transported with a transport roller 19, and a discharge transport roller 20 discharges the sheet outside the apparatus. A discharge unit 31 including the transport roller 19 and the discharge transport roller 20 is provided for discharging the sheet transported from the fixing device 18 to an upper cover 23, so that the sheet is placed on the upper cover 23.

LED heads 21Bk, 21Y, 21M, and 21C are arranged as exposure devices to face the image forming units 22Bk, 22Y, 22M, and 22C, respectively, for exposing surfaces of the photosensitive drums 52Bk, 52Y, 52M, and 52C to form latent images thereof.

The image forming units 22Bk, 22Y, 22M, and 22C are detachably attached to a main body of the printer. The upper cover 23 is disposed at an upper portion of the main body of the printer to freely open and close for attaching and detaching the image forming units 22Bk, 22Y, 22M, and 22C. The LED heads 21Bk, 21Y, 21M, and 21C are supported on the upper cover 23.

The fixing device 18 is provided with a fixing roller 25 as a fixing member driven to rotate with a fixing motor (described later) as a diving unit for fixing; and a pressing roller 26 as a pressing member rotating together with the fixing roller 25. A heater 25*a* as a heating member is disposed in the fixing roller 25 for melting toner on the sheet.

In the embodiment, the fixing roller 25 is formed of a metal shaft made of steel or aluminum and covered with an elastic member made of silicone rubber and the likes. A surface of the elastic member is coated with a fluorine type resin, so that toner does not stick easily. Further, the pressing roller 26 is formed of a metal shaft made of steel or aluminum and covered with an elastic member made of silicone rubber and the likes. A surface of the elastic member is coated with a fluorine type resin. Accordingly, when a paper jam occurs during transportation of the sheet, it is possible to prevent toner of the toner image not fixed from off setting and sticking to the fixing roller 25.

A fixing thermistor 30 is arranged as a fixing device temperature detection unit to face the fixing roller 25. The heater 25*a* is controlled through intermittent control or on-off control according to a temperature detected by the fixing thermistor 30, so that the fixing roller 25 maintains a specific fixing temperature. An environmental thermistor 32 is arranged as an external temperature detection unit or an environmental temperature detection unit for detecting an environmental temperature outside the printer. In FIG. 2, it looks as if the environmental thermistor 32 is disposed in the sheet supply mechanism. In an actual arrangement, the environmental thermistor 32 is disposed adjacent to an external member as a housing of the printer.

Figure 3:
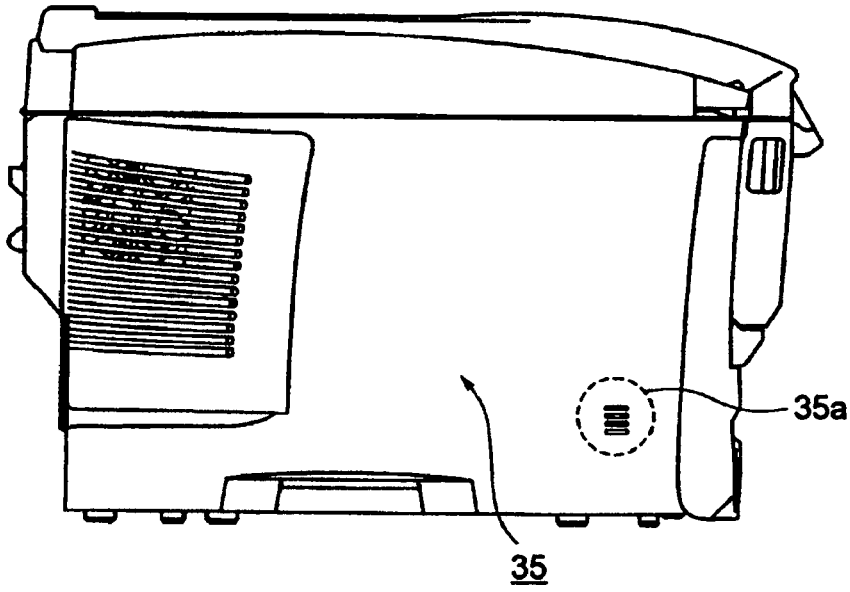
FIG. 3 is a side view showing the printer according to the first embodiment of the present invention.
Figure 4:
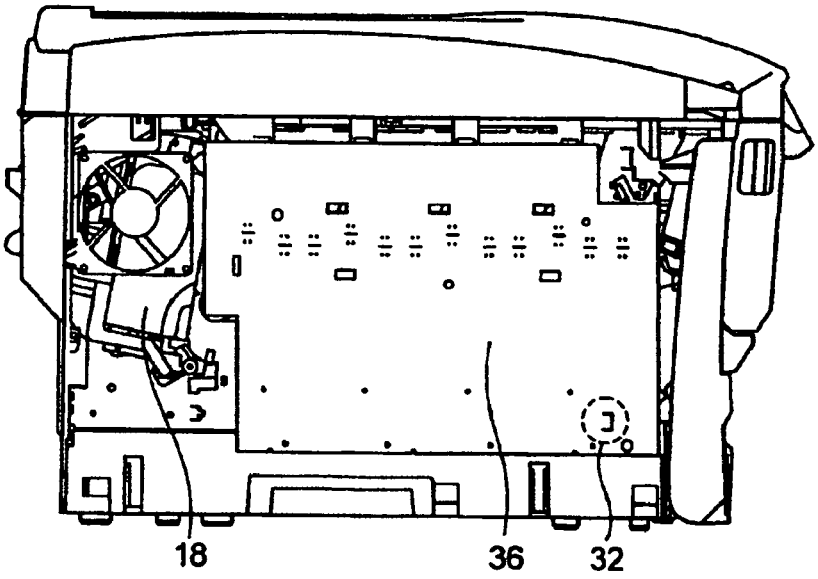
FIG. 4 is a side view showing the printer with an external member removed according to the first embodiment of the present invention.
Figure 5:
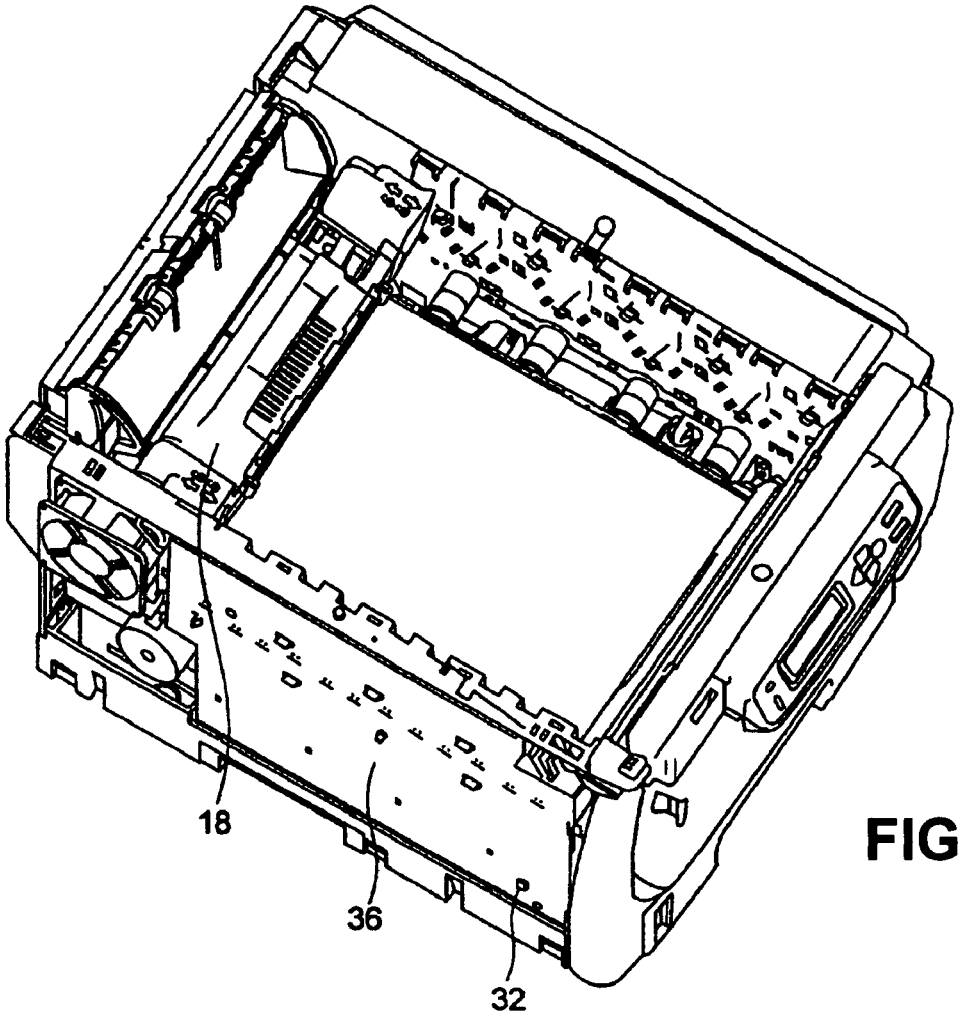
FIG. 5 is a perspective view showing the printer with the external member removed according to the first embodiment of the present invention.

FIG. 3 is a side view showing the printer according to the first embodiment of the present invention. FIG. 4 is a side view showing the printer with an external member removed according to the first embodiment of the present invention. FIG. 5 is a perspective view showing the printer with the external member removed according to the first embodiment of the present invention.

As shown in FIG. 3, a hole 35*a* is formed as an air hole in an external member 35 of the printer. The environmental thermistor 32 is disposed on a board 36 that applies a high transfer voltage to the transfer rollers 51Bk, 51Y, 51M, and 51C, so that the environmental thermistor 32 is arranged adjacent to (at a backside of) the hole 35*a* to face the same.

The board 36 is arranged to face the external member 35, and the environmental thermistor 32 is disposed on a surface of the board 36 facing the external member 35. Accordingly, the environmental thermistor 32 is separated from inside the printer with the board 36, thereby preventing the environmental thermistor 32 from receiving thermal effect from inside the printer. The board 36 covers a whole side surface of each of the image forming units 22Bk, 22Y, 22M, and 22C, thereby functioning as a partition member for dividing inside and outside the printer.

The environmental thermistor 32 is disposed on the board 36 below the fixing device 18 at a front portion of the printer. Further, the environmental thermistor 32 is disposed at an upstream side of the fixing device 18 in a direction that the sheet is transported. Further, as shown in FIG. 5, the environmental thermistor 32 is disposed close to the external member 35, so that it is possible to accurately detect an environmental temperature outside the printer.

The image forming units 22Bk, 22Y, 22M, and 22C will be explained in more detail next. Since the image forming units 22Bk, 22Y, 22M, and 22C have an identical internal configuration (although a toner color is different), only the image forming unit 22Bk will be explained.

Figure 1:
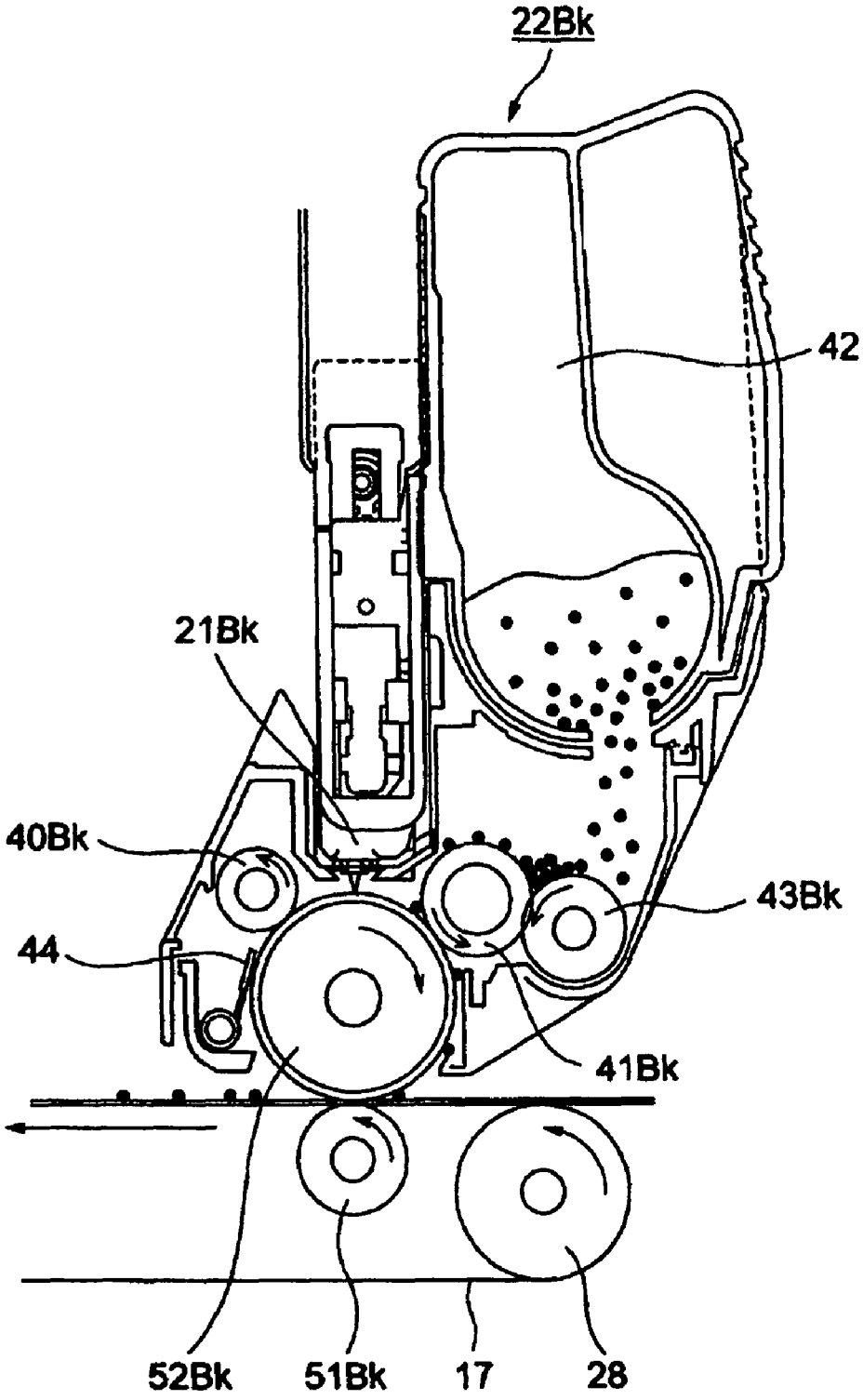
FIG. 1 is a schematic sectional view showing an image forming unit according to a first embodiment of the present invention.

FIG. 1 is a schematic sectional view showing an image forming unit 22Bk according to the first embodiment of the present invention.

As shown in FIG. 1, the image forming unit 22Bk includes a charging roller 40Bk as a charging device for uniformly charging a surface of the photosensitive drum 52Bk rotating in an arrow direction; a developing roller 41Bk as a developer supporting member for developing the latent image or static latent image to form the toner image; a toner cartridge 42 as a developer cartridge detachably attached to a main body of the image forming unit 22Bk or an image forming unit main body for retaining non-magnetic two-component toner; and a sponge roller 43Bk as a developer supply member for supplying toner supplied from the toner cartridge 42 to the developing roller 41Bk.

In the embodiment, the charging roller 40Bk and the developing roller 41Bk rotate through gears (not shown), so that there is a difference in a circumferential speed or a circumferential speed difference relative to the photosensitive drum 52Bk. The sponge roller 43Bk rotates in a direction same as that of the developing roller 41Bk through a gear (not shown), so that there is a circumferential speed difference relative to the developing roller 41Bk.

An internal thermistor 44 is arranged adjacent to the photosensitive drum 52Bk to face the same as an internal temperature detection unit or a photosensitive member temperature detection unit. The internal thermistor 44 detects a temperature of the surface of the photosensitive drum 52Bk as an internal temperature or a temperature inside the image forming unit 22Bk. According to the surface temperature thus detected, it is determined whether there is a risk of deteriorating toner when toner sticks to the photosensitive drum 52Bk.

The internal thermistor 44 is disposed outside a printing area of the transfer roller 51Bk at a downstream side thereof and an upstream side of the developing roller 41Bk in a rotational direction of the photosensitive drum 52Bk. Accordingly, the internal thermistor 44 can detect the surface temperature of the photosensitive drum 52Bk after the toner image on the photosensitive drum 52Bk is transferred to the sheet. With this configuration, it is possible to prevent unfixed toner from sticking. Further, when a paper jam occurs, it is possible to prevent the internal thermistor 44 from deforming.

Figure 6:
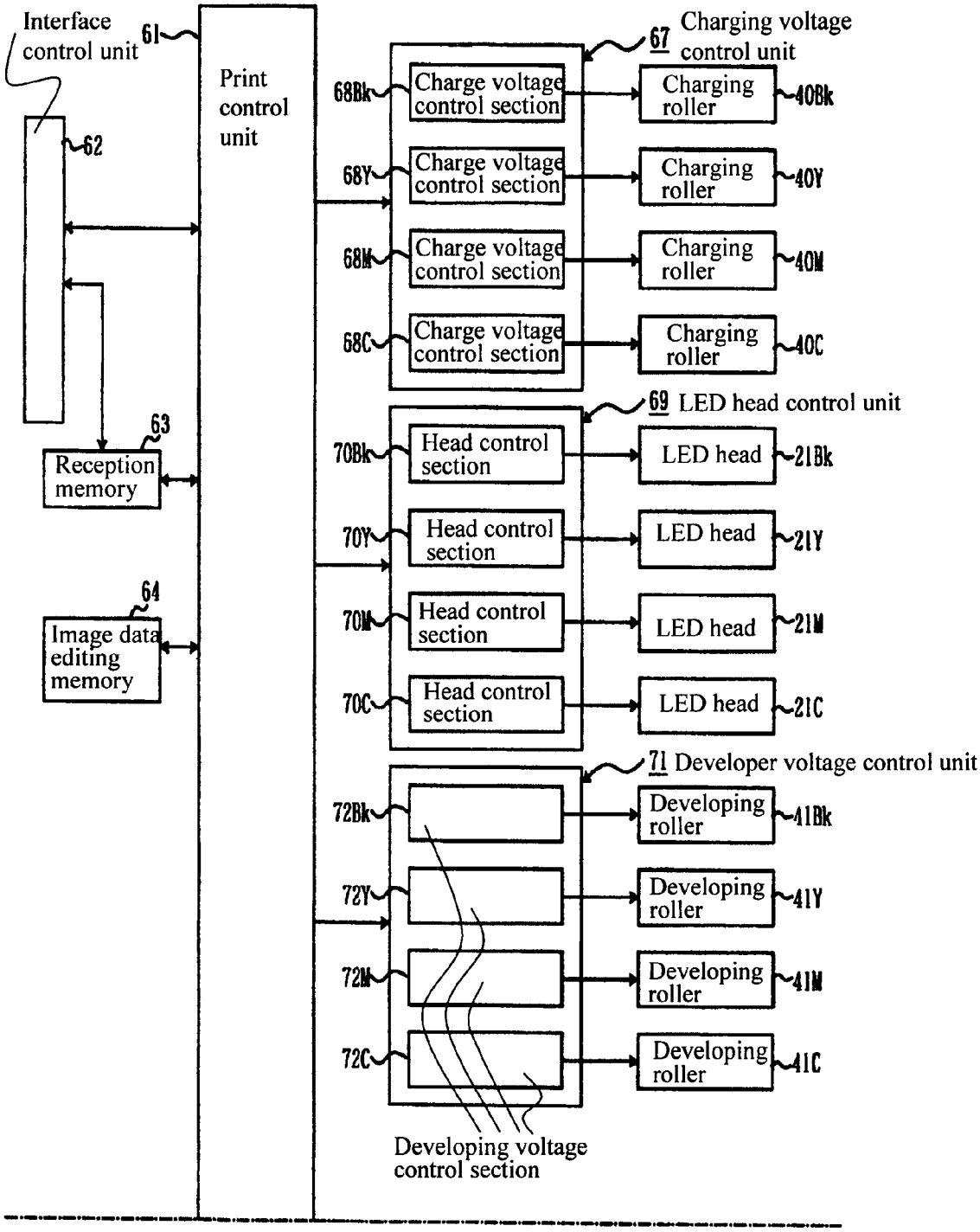
FIG. 6 is a block diagram No. 1 of a control system of the printer according to the first embodiment of the present invention.
Figure 7:
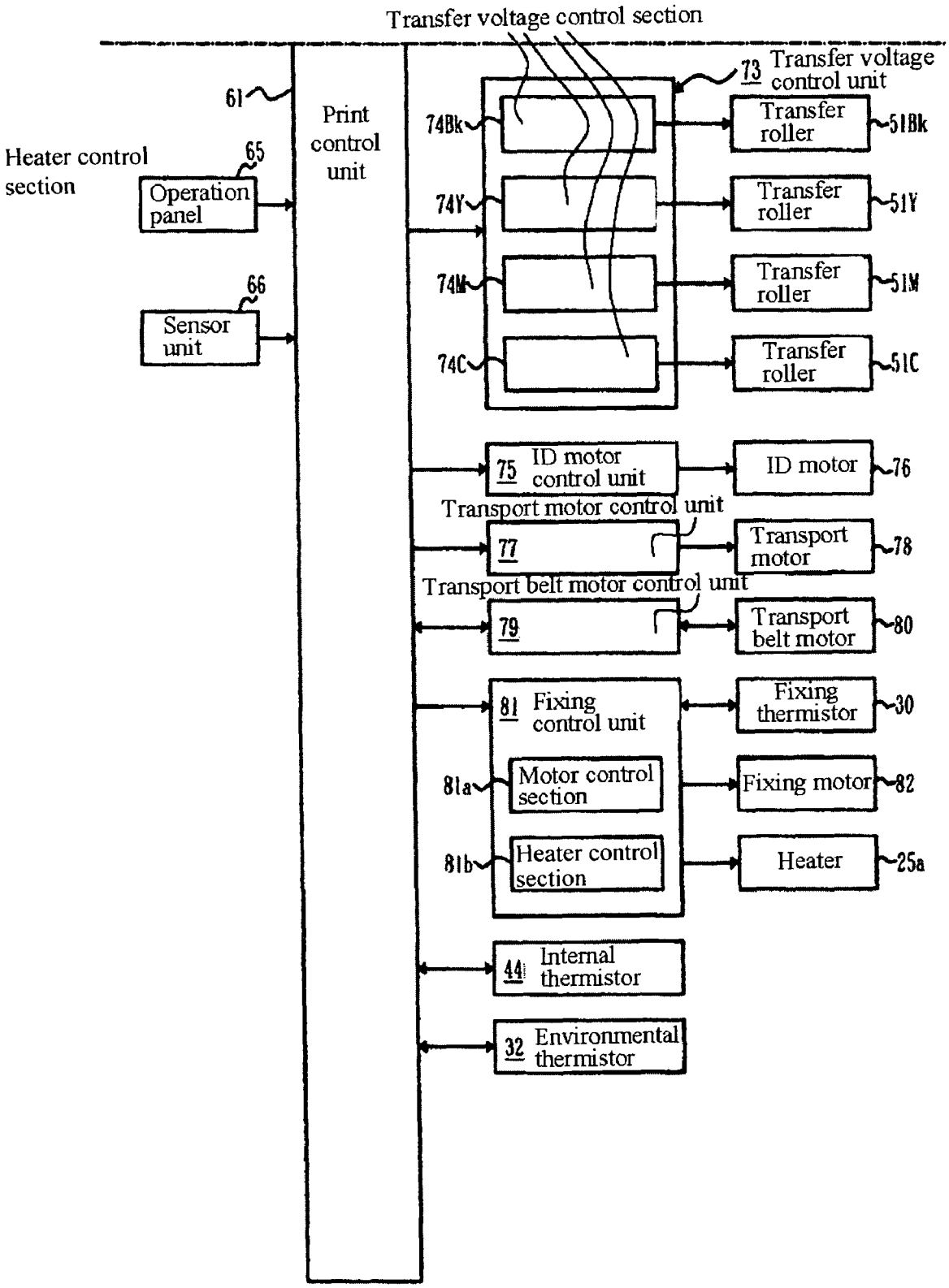
FIG. 7 is a block diagram No. 2 of the control system of the printer according to the first embodiment of the present invention.

A control system of the printer will be explained next. FIG. 6 is a block diagram No. 1 of the control system of the printer according to the first embodiment of the present invention. FIG. 7 is a block diagram No. 2 of the control system of the printer according to the first embodiment of the present invention. In FIGS. 6 and 7, a print control unit 61 is shown in a divided state.

As shown in FIG. 6, the print control unit 61 as a control unit includes a microprocessor (not shown), a ROM, a RAM, an input/output port, a timer, and the likes. The print control unit 61 controls a printing operation of the printer as a whole to perform the printing operation for forming a color image according to print data and a print command received from an upper device such as a host computer through an interface control unit 62.

The interface control unit 62 sends information representing a status of the printer to the host computer. The interface control unit 62 also analyzes a control command sent from the host computer, and stores the print data thus received in a reception memory 63 per color. After the print data is input from the host computer through the interface control unit 62, the print control unit 61 edits the print data. The print data thus edited is stored in an image data editing memory 64 as image data for each color to be sent to the LED heads 21Bk, 21Y, 21M, and 21C. The image data editing memory 64 receives the print data temporarily stored in the reception memory 64, and stores the image data to be sent to the LED heads 21Bk, 21Y, 21M, and 21C.

An operation panel 65 as an operation unit includes an LED (not shown) for displaying the status of the printer and a switch so that an operator inputs a command to be sent to the printer.

A sensor unit 66 includes a plurality of sensors for detecting a transportation position of the sheet; a sensor for detecting a temperature and humidity inside the printer; and a sensor for detecting a dot density of a color image. The sensor unit 66 sends a sensor signal to the print control unit 61.

In the embodiment, the print control unit 61 is connected to a charging voltage control unit 67; a head control unit 69; a developer voltage control unit 71; a transfer voltage control unit 73; an ID motor control unit 75; a transport motor control unit 77; a transport belt motor control unit 79; and a fixing control unit 81.

In the embodiment, the charging voltage control unit 67 receives a direction from the print control unit 61 to perform control of applying a voltage to each of the charging rollers 40Bk, 40Y, 40M, and 40C, so that the surfaces of the photosensitive drums 52Bk, 52Y, 52M, and 52C are charged. Note that the charging voltage control unit 67 includes charge voltage control sections 68Bk, 68Y, 68M, and 68C for performing control for each color to adjust a charge voltage to be applied to each of the charging rollers 40Bk, 40Y, 40M, and 40C.

In the embodiment, the head control unit 69 receives a direction from the print control unit 61 to perform control of receiving the image data of each color stored in the image data editing memory 64 and sending the image data to each of the LED heads 21Bk, 21Y, 21M, and 21C, so that LED elements of LED arrays selectively emit light to irradiate the surfaces of the photosensitive drums 52Bk, 52Y, 52M, and 52C to be charged, thereby forming latent images on the photosensitive drums 52Bk, 52Y, 52M, and 52C. Note that the head control unit 69 includes head control sections 70Bk, 70Y, 70M, and 70C for performing control of sending the image data to each of the LED heads 21Bk, 21Y, 21M, and 21C at a specific timing.

In the embodiment, the developer voltage control unit 71 receives a direction from the print control unit 61 to perform control of applying a developing voltage to each of the developing rollers 41Bk, 41Y, 41M, and 41C, so that toner sticks to the latent images formed on the photosensitive drums 52Bk, 52Y, 52M, and 52C, thereby forming the toner images on the photosensitive drums 52Bk, 52Y, 52M, and 52C. Note that the developer voltage control unit 71 includes developing voltage control sections 72Bk, 72Y, 72M, and 72C for performing control of adjusting the developing voltage to be applied to the developing rollers 41Bk, 41Y, 41M, and 41C, so that the toner images are formed in areas exposed by each of the LED heads 21Bk, 21Y, 21M, and 21C.

In the embodiment, the transfer voltage control unit 73 receives a direction from the print control unit 61 to perform control of applying a transfer voltage to each of the transfer rollers 51Bk, 51Y, 51M, and 51C, so that the toner images formed on the photosensitive drums 52Bk, 52Y, 52M, and 52C are transferred to the sheet. Note that the transfer voltage control unit 73 includes transfer voltage control sections 74Bk, 74Y, 74M, and 74C for performing control for each color and transferring the toner images to the sheet sequentially.

In the embodiment, the ID motor control unit 75 receives a direction from the print control unit 61 to drive an ID motor 76 as a drive unit for forming the image to rotate each of the photosensitive drums 52Bk, 52Y, 52M, and 52C; the charging rollers 40Bk, 40Y, 40M, and 40C; and the developing rollers 41Bk, 41Y, 41M, and 41C.

In the embodiment, the transport motor control unit 77 drives a transportation motor 78 as a drive unit for transportation to transport the sheet to the image forming units 22Bk, 22Y, 22M, and 22C. Further, the transport belt motor control unit 79 drives a transportation belt motor 80 to transport the sheet with the toner images transferred with the photosensitive drums 52Bk, 52Y, 52M, and 52C at the image forming units 22Bk, 22Y, 22M, and 22C to the fixing device 18.

In the embodiment, the fixing control unit 81 receives a direction from the print control unit 61 to perform control of applying a fixing voltage to the heater 25*a* disposed in the fixing device 18 (FIG. 1), so that the toner images transferred to the sheet are fixed. Note that the fixing control unit 81 includes a heater control section 81*b* for performing on-off control for the heater 25*a* according to the temperature detected by the fixing thermistor 30. When the fixing device 18 reaches a specific setting temperature, a motor control section 81*a* drives a fixing motor 82 as a drive unit for fixing to rotate the fixing roller 25 and the pressing roller 26.

In the embodiment, the internal thermistor 44 is provided for detecting the surface temperature of the photosensitive drum 52Bk, and the environmental thermistor 32 is provided for detecting the environmental temperature outside the apparatus.

In the image forming units 22Bk, 22Y, 22M, and 22C, when the ID motor 76 starts driving, the photosensitive drums 52Bk, 52Y, 52M, and 52C; the charging rollers 40Bk, 40Y, 40M, and 40C; and the developing rollers 41Bk, 41Y, 41M, and 41C rotate. At this time, the photosensitive drums 52Bk, 52Y, 52M, and 52C rotate at a circumferential speed different from those of the charging rollers 40Bk, 40Y, 40M, and 40C and the developing rollers 41Bk, 41Y, 41M, and 41C, thereby generating frictional heat due to the circumferential speed difference. Further, the sponge rollers 43Bk, 43Y, 43M, and 43C rotate not only at a circumferential speed different from that of the developing rollers 41Bk, 41Y, 41M, and 41C, but in a direction same as that of the developing rollers 41Bk, 41Y, 41M, and 41C for charging toner, thereby generating a large amount of frictional heat.

In the embodiment, when the image forming apparatus is installed in a high temperature environment, the print speed, i.e., the image forming speed or the driving speed, is decreased to reduce the frictional heat thus generated, thereby lowering the temperature inside the image forming apparatus.

To this end, in the embodiment, first, the print control unit 61 receives the control command and the print data sent from the host computer through the interface control unit 62. Upon receiving the print command from the host computer, the print control unit 61 determines a print speed V and a fixing temperature T according to the print information. In this case, the print control unit 61 sets print speeds V0, V1, and V2 and fixing temperatures T0, T1, and T2 according to the environmental temperature Te detected by the environmental thermistor 32.

In the embodiment, threshold values Tc1 and Tc2 (Tc1<Tc2) are determined in advance for determining whether the current environmental temperature is suitable for printing relative to discharging efficiency of heat of the image forming apparatus. Upon starting the image forming apparatus, the environmental temperature Te is compared with the threshold values Tc1 and Tc2 to select one of the print speeds V0, V1, and V2 (V0>V1>V2). As the environmental temperature Te increases, the print speed V is set to a lower speed.

When the print speed V decreases, an amount of hest per unit time transferred from the fixing roller 25 to the sheet increases. Accordingly, it is possible to decrease the fixing temperature T. The fixing temperatures T0, T1, and T2 are set to be T0>T1>T2.

In the embodiment, the print control unit 61 selects one of a continuous printing mode as a continuous image forming mode and an intermittent printing mode as an intermittent image forming mode according to the detected temperature Ti detected by the internal thermistor 44 for monitoring an increase in the internal temperature. More specifically, the print control unit 61 compares a threshold value Tc0 with the detected temperature Ti to select one of the continuous printing mode and the intermittent printing mode.

In the embodiment, when the image forming apparatus prints on the sheet having a weight per unit area of 80 g/m$^2$, the print speed V0 is set at 150 mm/sec., the print speed V1 is set at 140 mm/sec., and the print speed V2 is set at 120 mm/sec., respectively, as the suitable print speed. Further, the fixing temperature T0 is set at 225° C., the fixing temperature T1 is set at 220° C., and the fixing temperature T2 is set at 155° C.

In the embodiment, in determining the printing mode based on the environmental temperature Te detected by the environmental thermistor 32, the threshold value Tc1 is set at 25° C. and the threshold value Tc2 is set at 30° C. Further, in determining the printing mode based on the environmental temperature Ti detected by the internal thermistor 44, the threshold value Tc0 is set at 48° C. The print speeds are obtained when the ID motor 76, the transportation motor 78, the transportation belt motor 80, the fixing motor 82, and the likes are driven.

An operation of the printer with the configuration described above will be explained next.

Figure 8:
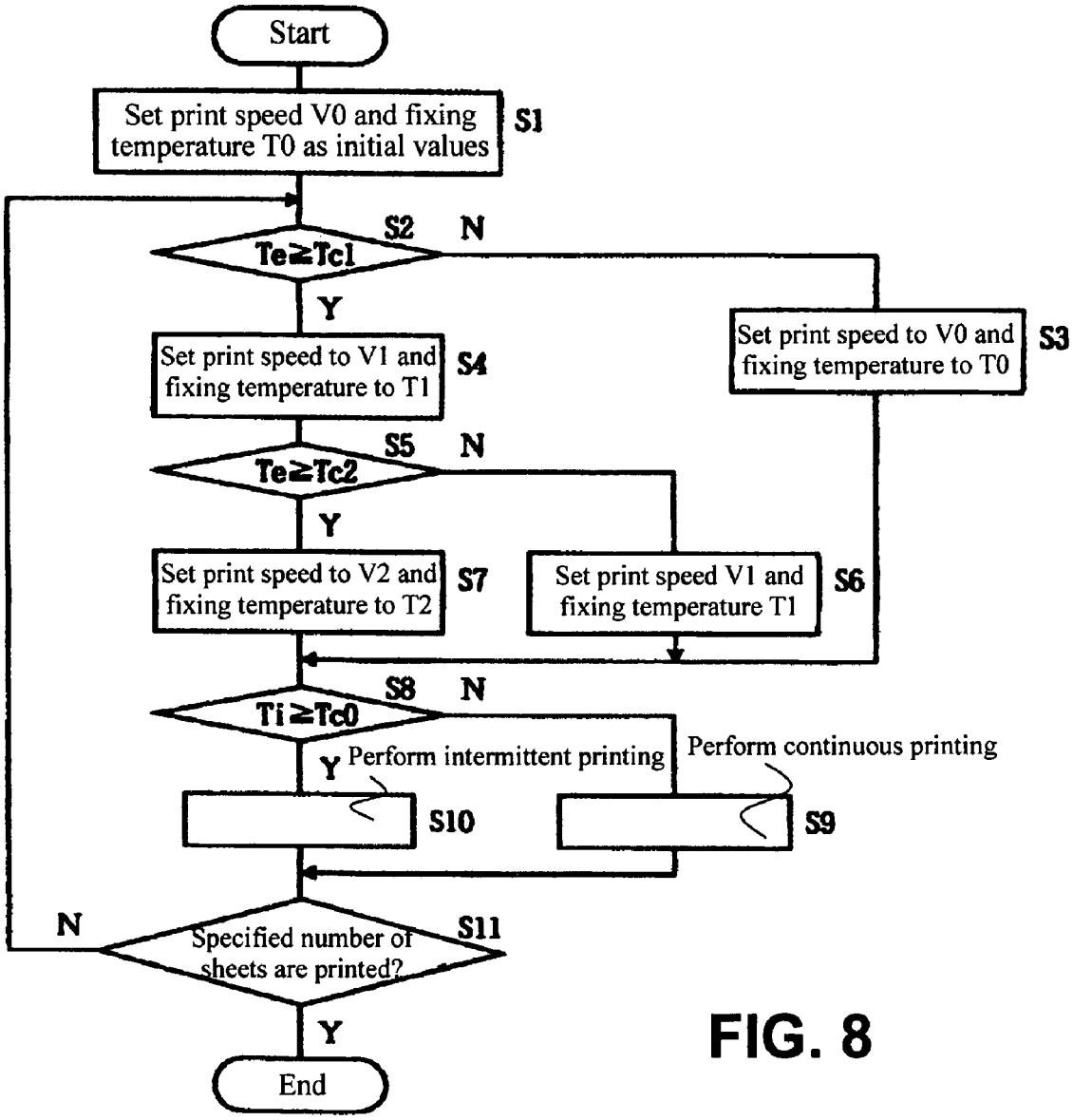
FIG. 8 is a flow chart of an operation of the printer according to the first embodiment of the present invention.

FIG. 8 is a flow chart of the operation of the printer according to the first embodiment of the present invention. FIG. 9 is a schematic view showing a control table of the external thermistor 32 according to the first embodiment of the present invention. FIG. 10 is a schematic view showing a control table of the internal thermistor 44 according to the first embodiment of the present invention.

First, the print control unit 61 receives the control command and the print data from the host computer through the interface control unit 62. Upon receiving the print command from the host computer, an initial value setting section (not shown) of the print control unit 61 sets the print speed V0 and the fixing temperature T0 as the initial values.

In the next step, an environmental temperature determining section (not shown) of the print control unit 61 reads the environmental temperature Te detected by the environmental thermistor 32, and compares the environmental temperature Te with the threshold value Tc1 (environmental temperature determining process). When the environmental temperature Te is lower than the threshold value Tc1, a condition setting section (not shown) of the print control unit 61 sets the print speed V to V0 and the fixing temperature T to T0. When the environmental temperature Te is higher than the threshold value Tc1, the condition setting section of the print control unit 61 sets the print speed V to V1 and the fixing temperature T to T1.

In the next step, the environmental temperature determining section of the print control unit 61 compares the environmental temperature Te with the threshold value Tc2. When the environmental temperature Te is lower than the threshold value Tc2, the condition setting section of the print control unit 61 sets the print speed V to V1 and the fixing temperature T to T1. When the environmental temperature Te is higher than the threshold value Tc2, the condition setting section of the print control unit 61 sets the print speed V to V2 and the fixing temperature T to T2.

In the next step, an internal temperature determining section (not shown) of the print control unit 61 reads the internal temperature Ti with the internal thermistor 44, and compares the internal temperature Ti with the threshold value Tc0 (internal temperature determining process). When the internal temperature Ti is lower than the threshold value Tc0, a mode selecting section (not shown) of the print control unit 61 selects the continuous printing mode, and the condition setting section of the print control unit 61 sets the print speed V to V0 and the fixing temperature T to T0. In the continuous printing mode, when the print data becomes ready at the print control unit 61, the printing operation is performed sequentially.

When the internal temperature Ti is higher than the threshold value Tc0, the mode selecting section of the print control unit 61 selects the intermittent printing mode, and the condition setting section of the print control unit 61 sets the print speed V to V0 and the fixing temperature T to T0. In the intermittent printing mode, when the predetermined condition is met, i.e., in the embodiment, when the internal temperature Ti is higher than the threshold value Tc0, the printing operation is stopped for a predetermined period of time.

Afterward, an image forming section (not shown) of the print control unit 61 performs the image forming process to print on a predetermined number of sheets.

More specifically, a fixing temperature determining section of the image forming section sends a direction to the fixing control unit 81 (FIG. 7) to read the temperature of the fixing roller 25 with the fixing thermistor 30, so that it is determined whether the temperature of the fixing roller 25 is within an operatable temperature range (fixing temperature determining process). When the temperature of the fixing roller 25 is not within the operatable temperature range, a fixing device heating section (not shown) of the image forming section turns on the heater 25*a* to heat the fixing roller 25 until the temperature of the fixing roller 25 is within the operatable temperature range (fixing device heating process).

In this process, when the detected temperature reaches the fixing temperature T, a fixing device rotating section (not shown) of the image forming section sends a direction to the fixing control unit 81 (FIG. 7) to drive the fixing motor 82, so that the fixing roller 25 rotates at a speed corresponding to the print speed V (fixing device rotating process).

In the next step, a drive section (not shown) of the image forming section drives the ID motor 76 at the print speed V through the ID motor control unit 75 and the transport belt motor control unit 79 for rotating the photosensitive drums 52Bk, 52Y, 52M, and 52C; the charging rollers 40Bk, 40Y, 40M, and 40C; and the developing rollers 41Bk, 41Y, 41M, and 41C (drive process). At the same time, a voltage control section (not shown) of the image forming section sends a direction to the charging voltage control unit 67, the developer voltage control unit 71, and the transfer voltage control unit 73 for applying the charge voltage, the developing voltage, and the transfer voltage to the charging rollers 40Bk, 40Y, 40M, and 40C; the developing rollers 41Bk, 41Y, 41M, and 41C; and the transfer rollers 51Bk, 51Y, 51M, and 51C, respectively (voltage control process).

A remaining sheet sensor (not show) is provided as a remaining medium detection unit for detecting a remaining amount of sheets. A sheet size sensor (not show) is provided as a recording medium size detection unit for detecting a size of the sheet. Further, a recording medium transport section (not shown) of the print control unit 61 sends a direction to the transport motor control unit 77 for driving the transportation motor 78, so that the sheet placed in the sheet supply cassette 11 is transported according to the size of the sheet (medium transportation process).

In the embodiment, the transportation motor 78 is capable of rotating in both directions. The medium transport section controls the transportation motor 78 to rotate in a reverse direction to pick up the sheet in the sheet supply cassette 11 and transport the sheet for a predetermined distance until a sheet inlet sensor (not shown) detects the sheet. Then, the medium transport section controls the transportation motor 78 to rotate in a forward direction to supply the sheet to the image forming units 22Bk, 22Y, 22M, and 22C.

When the sheet reaches a printable position, a head drive section (not shown) of the image forming section retrieves the image data from the image data editing memory 64 and sends the image data together with a specific timing signal to the head control unit 69. When the head control unit 69 receives the image data for one line, the head control unit 69 sends a latch signal to each of the LED heads 21Bk, 21Y, 21M, and 21C, so that the LED heads 21Bk, 21Y, 21M, and 21C hold the image data (head drive process).

Before receiving the next timing signal, the head control unit 69 sends a print drive signal STB to the LED heads 21Bk, 21Y, 21M, and 21C. As a result, the LED heads 21Bk, 21Y, 21M, and 21C perform the printing operation according to the image data thus held, thereby printing per line.

The LED heads 21Bk, 21Y, 21M, and 21C irradiate the surfaces of the photosensitive drums 52Bk, 52Y, 52M, and 52C. Accordingly, the latent image is formed as dots with a high potential on the surfaces of the photosensitive drums 52Bk, 52Y, 52M, and 52C.

Then, toner charged with negative polarity is attracted to each of the dots through electrical attractive force, thereby forming the toner image. Afterward, the toner image is sent to a transfer portion (not shown) between the photosensitive drums 52Bk, 52Y, 52M, and 52C and the transfer rollers 51Bk, 51Y, 51M, and 51C.

A transfer section (not shown) of the image forming section sends a direction to the transfer voltage control unit 73 to apply the transfer voltage with positive potential to the transfer rollers 51Bk, 51Y, 51M, and 51C (transfer process). Accordingly, the transfer rollers 51Bk, 51Y, 51M, and 51C transfer the toner image to the sheet passing through the transfer portion. After the toner image is transferred, the sheet is transported to the fixing device 18, so that the toner image thus transferred is fixed with heat of the fixing device 18 at the fixing temperature T. After fixing the toner image, the sheet is transported further and passes through a sheet outlet sensor (not shown) as a recording medium discharge detection unit, so that the sheet is discharged outside the printer.

In the next step, a completion determining section (not shown) of the image forming section determines whether a specified number of sheets are printed according to the print command thus received (completion determining process). When a specified number of sheets are not printed, the environmental temperature determining section reads the environmental temperature Te, and compares the environmental temperature Te with the threshold value Tc1 one more time (environmental temperature determining process). When a specified number of sheets are printed, the process described above is repeated, so that the print speed V and the fixing temperature T are set and the printing mode is selected.

After a specified number of sheets are printed and the sheet passes through the sheet outlet sensor, the voltage control section stops applying the charge voltage, the developing voltage, and the transfer voltage to the charging rollers 40Bk, 40Y, 40M, and 40C; the developing rollers 41Bk, 41Y, 41M, and 41C; and the transfer rollers 51Bk, 51Y, 51M, and 51C, respectively. At the same time, the drive section stops driving the motors such as the ID motor 76, the transportation motor 78, the transportation belt motor 80, and the fixing motor 82. When the print command is received one more time, the process described above is repeated.

As described above, in the image forming units 22Bk, 22Y, 22M, and 22C according to the embodiment, when the ID motor 76 starts driving, the photosensitive drums 52Bk, 52Y, 52M, and 52C; the charging rollers 40Bk, 40Y, 40M, and 40C; and the developing rollers 41Bk, 41Y, 41M, and 41C rotate. At this time, the photosensitive drums 52Bk, 52Y, 52M, and 52C rotate at a circumferential speed different from those of the charging rollers 40Bk, 40Y, 40M, and 40C and the developing rollers 41Bk, 41Y, 41M, and 41C, thereby generating frictional heat due to the circumferential speed difference. Further, the sponge rollers 43Bk, 43Y, 43M, and 43C rotate not only at a circumferential speed different from that of the developing rollers 41Bk, 41Y, 41M, and 41C, but in a direction same as that of the developing rollers 41Bk, 41Y, 41M, and 41C for charging toner, thereby generating a large amount of frictional heat.

In the embodiment, when the image forming apparatus is installed in a high temperature environment, the print speed is decreased to reduce the frictional heat thus generated, thereby lowering the temperature inside the image forming apparatus. Accordingly, it is possible to prevent deterioration of toner, lowered flow characteristic of toner, and improper charging.

Further, in the present invention, when the print speed is decreased, it is possible to reduce heat conducted to the sheet, thereby making it possible to lower the fixing temperature. Further, it is possible to prevent the motors such as the ID motor 76, the transportation motor 78, the transportation belt motor 80, and the fixing motor 82 from generating a large amount of heat. Accordingly, even when the printing operation is performed continuously, it is possible to prevent the temperature inside the printer from rising. Further, it is possible to perform the continuous printing for a long period of time and reduce the operation time of the intermittent printing. Accordingly, it is possible to provide an operator with comfortable condition and obtain good print result.

The flow chart shown in FIG. 8 will be explained next. In step S1, the print speed V0 and the fixing temperature T0 are set as the initial values. In step S2, it is determined whether the environmental temperature Te is higher than the threshold value Tc1. When the environmental temperature Te is higher than the threshold value Tc1, the process proceeds to step S4. When the environmental temperature Te is lower than the threshold value Tc1, the process proceeds to step s3.

In step S3, the print speed V is set to V0 and the fixing temperature T is set to T0. In step S4, the print speed V is set to V1 and the fixing temperature T is set to T1. In step S5, it is determined whether the environmental temperature Te is higher than the threshold value Tc2. When the environmental temperature Te is higher than the threshold value Tc2, the process proceeds to step S7. When the environmental temperature Te is lower than the threshold value Tc2, the process proceeds to step S6.

In step S6, the print speed V is set to V1 and the fixing temperature T is set to T1. In step S7, the print speed V is set to V2 and the detected temperature Ti is set to T2. In step S8, it is determined whether the environmental temperature Te is higher than the threshold value Tc0. When the detected temperature Ti is higher than the threshold value Tc0, the process proceeds to step S10. When the detected temperature Ti is lower than the threshold value Tc0, the process proceeds to step S9.

In step S9, the continuous printing is performed. In step S10, the intermittent printing is performed. In step 11, it is determined whether a specified number of sheets are printed. When a specified number of sheets are printed, the process is completed. When a specified number of sheets are not printed, the process returns to step S2.

In the embodiment, the internal thermistor 44 is disposed in each of the photosensitive drums 52Bk, 52Y, 52M, and 52C disposed in the image forming units 22Bk, 22Y, 22M, and 22C. Accordingly, it is possible to prevent deterioration of toner through monitoring the temperatures of the photosensitive drums 52Bk, 52Y, 52M, and 52C all the time. However, when the internal thermistor 44 is disposed in each of the photosensitive drums 52Bk, 52Y, 52M, and 52C, cost of the printer increases. When the internal thermistor 44 is disposed at a limited location, the printer exhibits the following characteristic.

Figure 11:
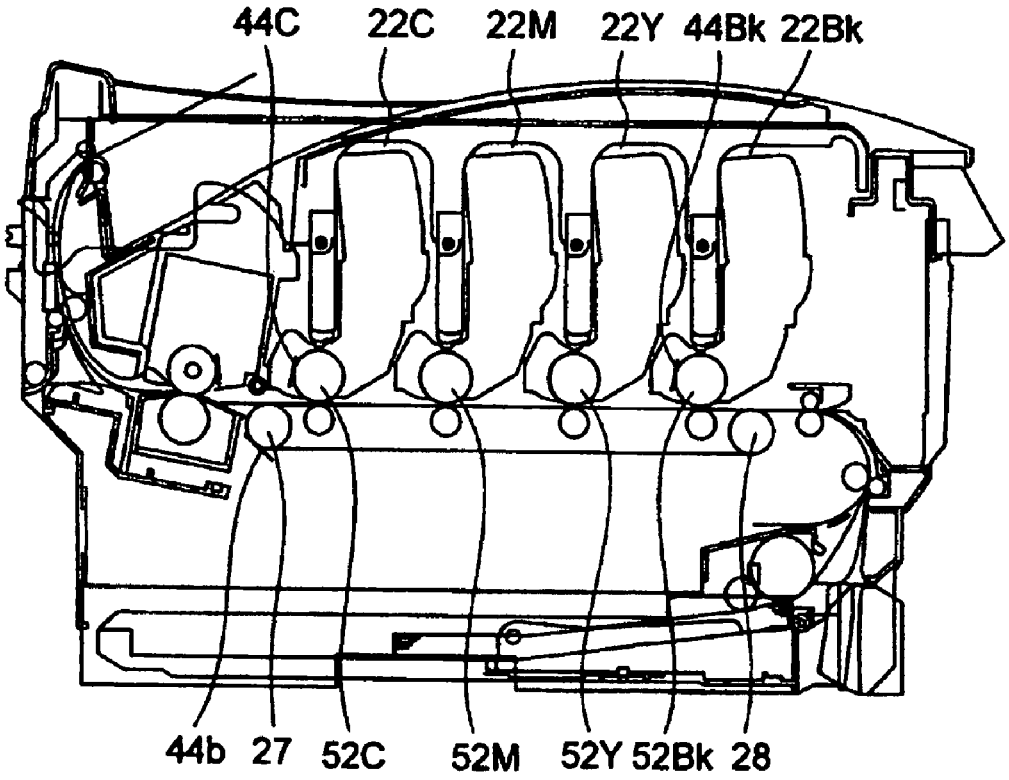
FIG. 11 is a schematic view showing an example of an installation location of the internal thermistor according to the first embodiment of the present invention.
Figure 12:
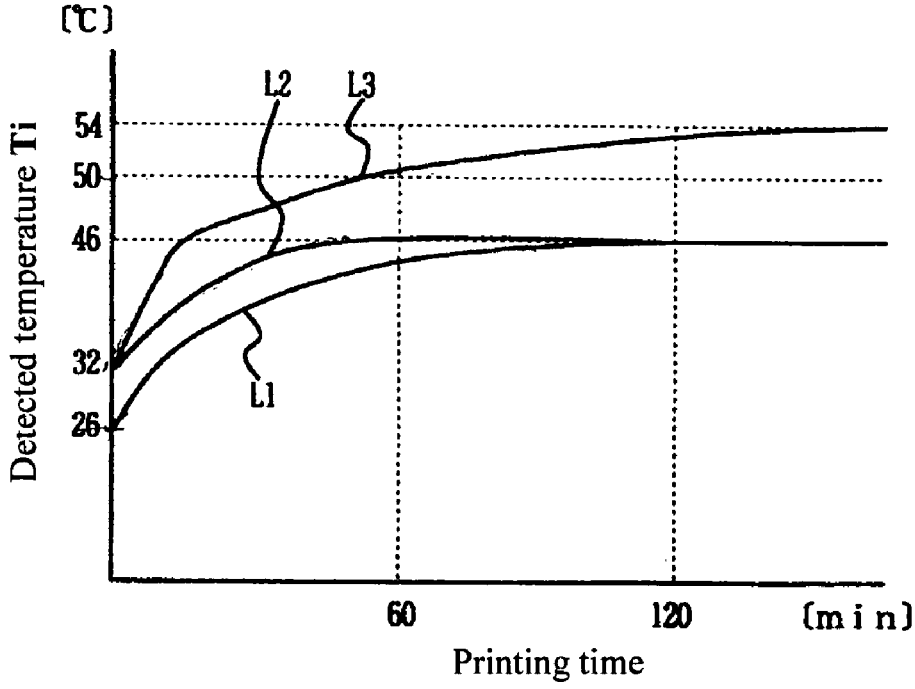
FIG. 12 is a graph showing a relationship between a temperature detected by the internal thermistor and a printing time when the printer starts a printing operation according to the first embodiment of the present invention.
Figure 13:
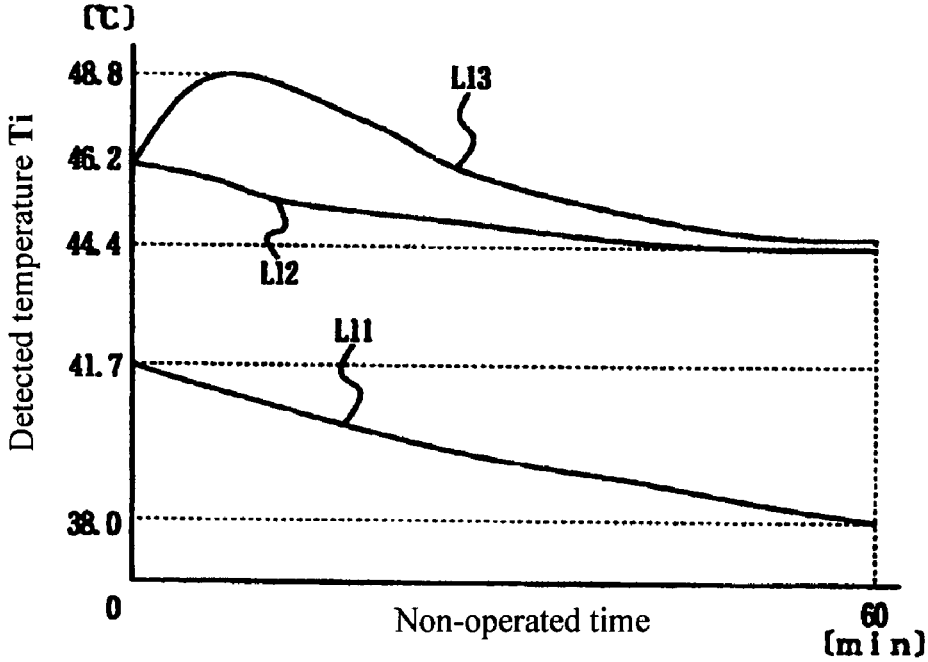
FIG. 13 is a graph showing a relationship between the temperature detected by the internal thermistor and the printing time when the printer stops the printing operation according to the first embodiment of the present invention.

FIG. 11 is a schematic view showing an example of an installation location of the internal thermistor 44 according to the first embodiment of the present invention. FIG. 12 is a graph showing a relationship between the temperature detected by the internal thermistor 44 and a printing time when the printer starts the printing operation according to the first embodiment of the present invention. FIG. 13 is a graph showing a relationship between the temperature detected by the internal thermistor 44 and the printing time when the printer stops the printing operation according to the first embodiment of the present invention. In FIGS. 12 and 13, the horizontal axis represents the printing time or non-operated time, and the vertical axis represents the detected temperature.

As shown in FIG. 11, an internal thermistor 44Bk is disposed in the image forming unit 22Bk to face the photosensitive drum 52Bk. An internal thermistor 44C is disposed in the image forming unit 22C to face the photosensitive drum 52C. An internal thermistor 44*b* is disposed to face the drive roller 27 as an internal temperature detection unit for detecting an internal temperature as a surface temperature of the drive roller 27.

In the chart shown in FIG. 12, a line L1 represents a change with time in the temperature of the photosensitive drum 52Bk detected by the internal thermistor 44Bk when the printer is started. A line L2 represents a change with time in the temperature of the photosensitive drum 52C detected by the internal thermistor 44C when the printer is started. A line L3 represents a change with time in the temperature of the drive roller 27 detected by the internal thermistor 44*b* when the printer is started.

In the chart shown in FIG. 13, a line L11 represents a change with time in the temperature of the photosensitive drum 52Bk detected by the internal thermistor 44Bk when the printer is stopped. A line L12 represents a change with time in the temperature of the photosensitive drum 52C detected by the internal thermistor 44C when the printer is stopped. A line L13 represents a change with time in the temperature of the drive roller 27 detected by the internal thermistor 44*b* when the printer is stopped.

As shown in FIGS. 12 and 13, when the lines L2 and L12 are compared with the lines L1 and L11, it is found that the lines L2 and L12 stay at a temperature higher than the lines L1 and L11. Accordingly, it is concluded that the photosensitive drum 52C reaches at a temperature higher than that of the photosensitive drum 52Bk. From this result, it is possible to dispose only the internal thermistor 44C in the photosensitive drum 52C for monitoring the internal temperature, thereby reducing cost of the printer.

When the temperature changes of the photosensitive drums 52Bk, 52Y, 52M, and 52C are determined in advance, it is possible to dispose an internal thermistor in one of the photosensitive drums 52Bk, 52Y, 52M, and 52C. Then, according to the temperature change in the one of the photosensitive drums 52Bk, 52Y, 52M, and 52C, it is possible to estimate the internal temperature of toner. Then, the print speed and the fixing temperature can be set according to the environmental temperature outside the printer.

In general, the image forming units 22Bk, 22Y, 22M, and 22C have a life shorter than that of the printer itself. Accordingly, no thermistor may be disposed in the image forming units 22Bk, 22Y, 22M, and 22C. As shown in FIG. 11, one internal thermistor 44*b* is disposed to abut against the transport belt 17, thereby reducing cost of the printer.

In this case, if there is established in advance a relationship between the temperature of the drive roller 27 detected by the internal thermistor 44*b* and the temperatures of the photosensitive drums 52Bk, 52Y, 52M, and 52C, it is possible to estimate the temperatures of the photosensitive drums 52Bk, 52Y, 52M, and 52C according to the temperature of the drive roller 27 detected by the internal thermistor 44*b*. Then, the print speed and the fixing temperature can be set according to the environmental temperature outside the printer.

Second Embodiment

In general, the sheet has a temperature equal to or higher than the environmental temperature outside the printer, and equal to or lower than the temperature inside the printer. Accordingly, when a small number of sheets are printed for a short period of time, the sheet tends to cool the surfaces of the photosensitive drums 52Bk, 52Y, 52M, and 52C. In contrast, when a large number of sheets are printed for a long period of time, the temperature inside the printer tends to increase rather quickly due to heat generated from the ID motor 76, the transportation motor 78, the fixing motor 82, and the image forming units 22Bk, 22Y, 22M, and 22C.

In a second embodiment of the present invention, the number of printed sheets during a specific period of time is measured, thereby controlling the temperatures of the image forming units 22Bk, 22Y, 22M, and 22C according to the environmental temperature outside the printer.

In the second embodiment, components similar to those in the first embodiment are designated by the same reference numerals, and explanations thereof are omitted. The components similar to those in the first embodiment provide effects same as those in the first embodiment.

Figure 14:
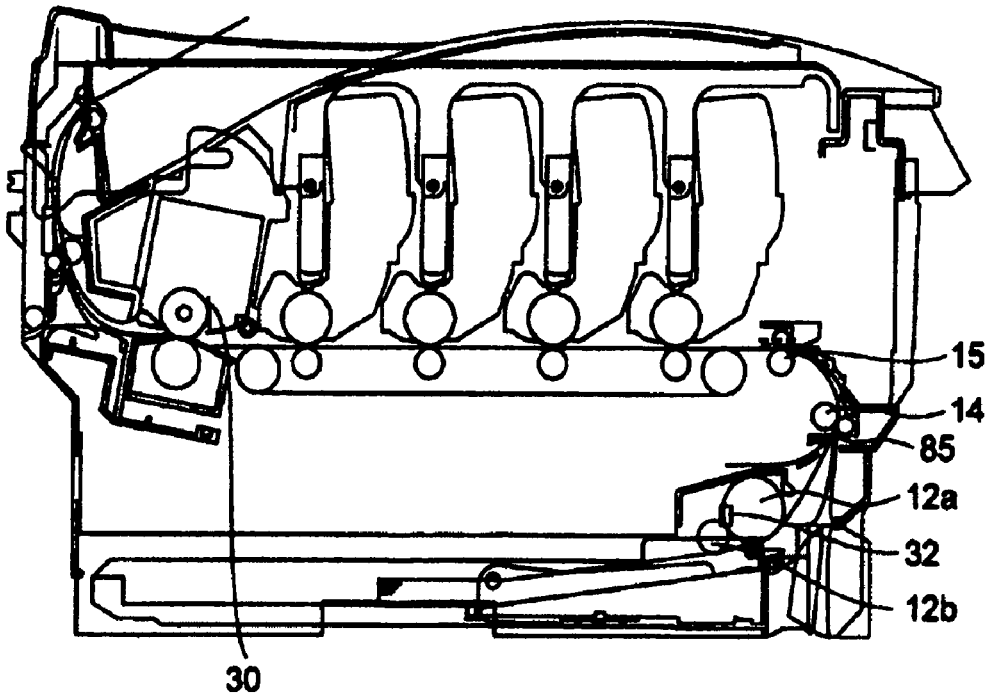
FIG. 14 is a schematic view showing a printer according to a second embodiment of the present invention.
Figure 15:
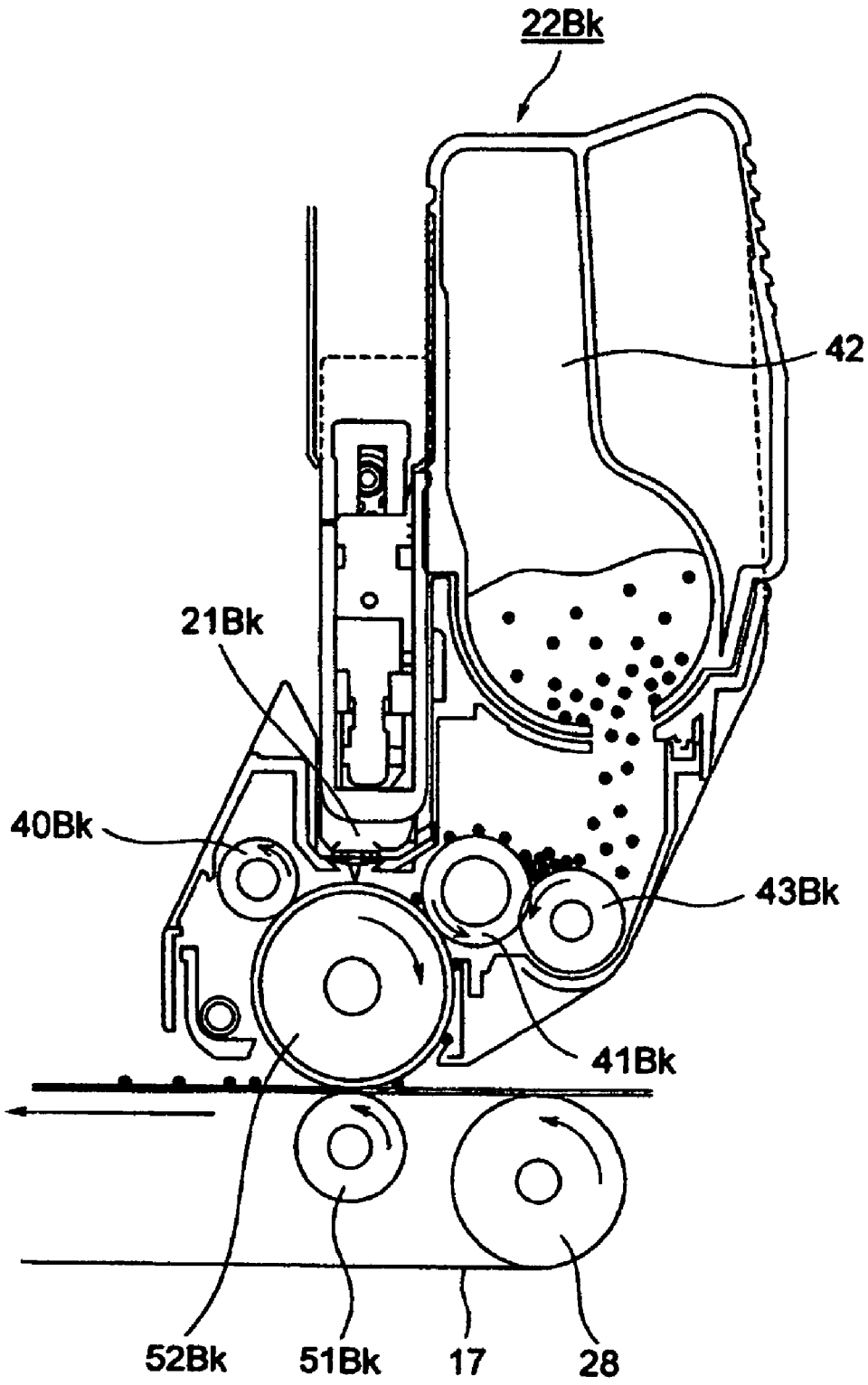
FIG. 15 is a schematic sectional view showing an image forming unit according to the second embodiment of the present invention.
Figure 16:
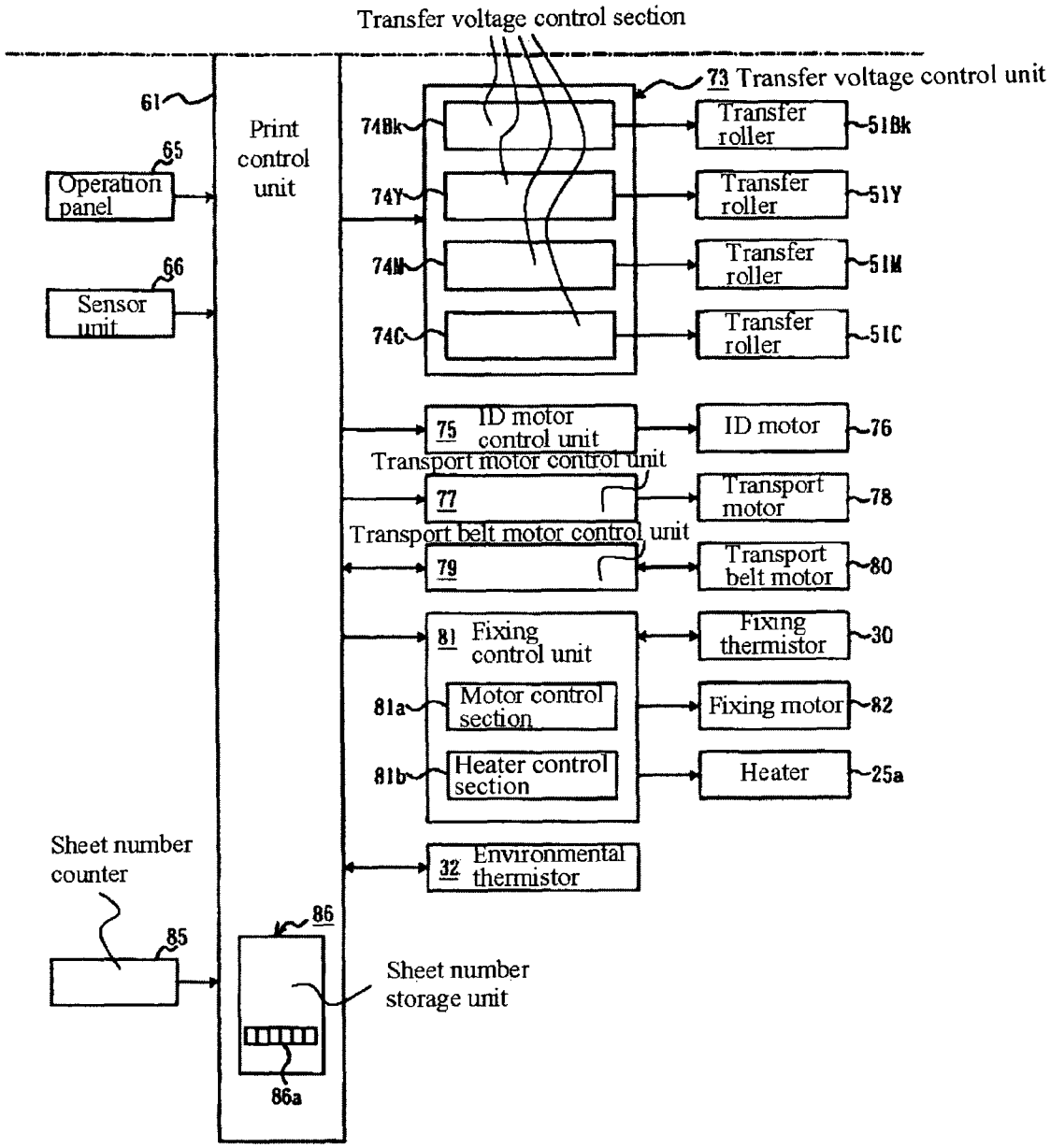
FIG. 16 is a block diagram of a control system of the printer according to the second embodiment of the present invention.

FIG. 14 is a schematic view showing a printer according to the second embodiment of the present invention. FIG. 15 is a schematic sectional view showing an image forming unit according to the second embodiment of the present invention. FIG. 16 is a block diagram of a control system of the printer according to the second embodiment of the present invention.

As shown in FIG. 14, a sheet number counter 85 is disposed in a transportation path between the sheet supply roller 12*a* and the transport rollers 14 and 15 for counting the number of the sheets passing therethrough. Note that the internal thermistors 44Bk and 44C are not disposed adjacent to the photosensitive drums 52Bk, 52Y, 52M, and 52C like in the first embodiment. A sheet number storage unit 86 is disposed in the print control unit 61 for storing the number of the sheets counted by the sheet number counter 85.

In the embodiment, the sheet number storage unit 86 is formed of a plurality of small blocks 86*a* (FIG. 15), thereby reducing a memory capacity of the sheet number storage unit 86. A sheet number recording unit (not shown) of the print control unit 61 starts counting the number of the sheets when the printer is turned on (sheet number recording process). The number of the sheets thus counted is stored in a specific block 86*a* for a specific period of time, i.e., in the embodiment, every 10 minutes.

An information updating unit (not shown) of the print control unit 61 deletes the number of the sheets stored previously to empty one of the blocks 86*a* and stores the number of the sheets counted in the next time period (information updating process). In the embodiment, the sheet number storage unit 86 has six blocks 86*a*, so that the numbers of the sheets are stored for maximum 60 minutes.

A printing mode determining unit (not shown) of the print control unit 61 compares a number of the sheets Pi counted previously with a threshold value Pc0 to determine whether the printing mode should be the continuous printing mode or the intermittent printing mode. In the embodiment, the threshold value Pc0 is set to 200 sheets.

Figure 17:
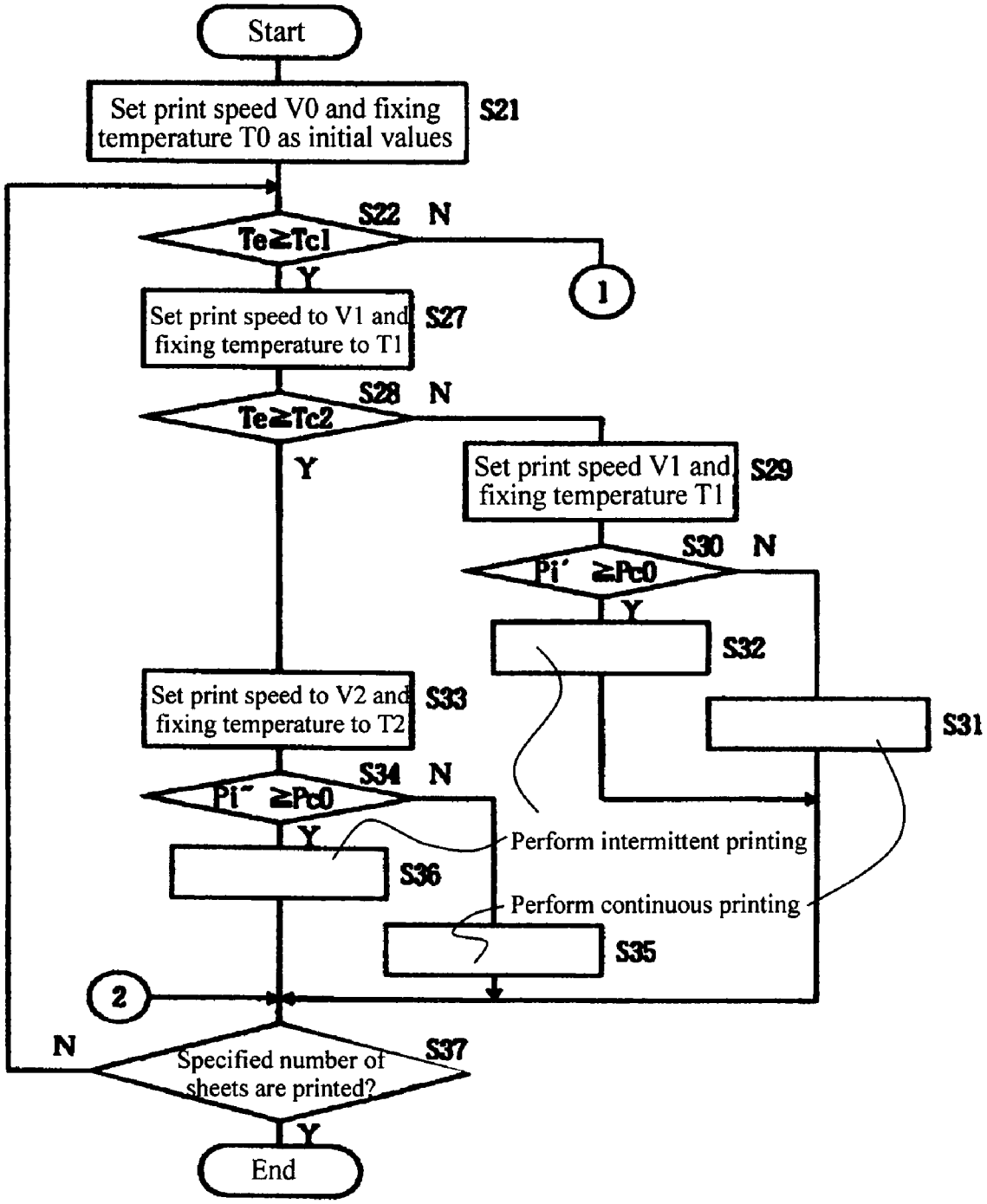
FIG. 17 is a flow chart No. 1 of an operation of the printer according to the second embodiment of the present invention.
Figure 18:
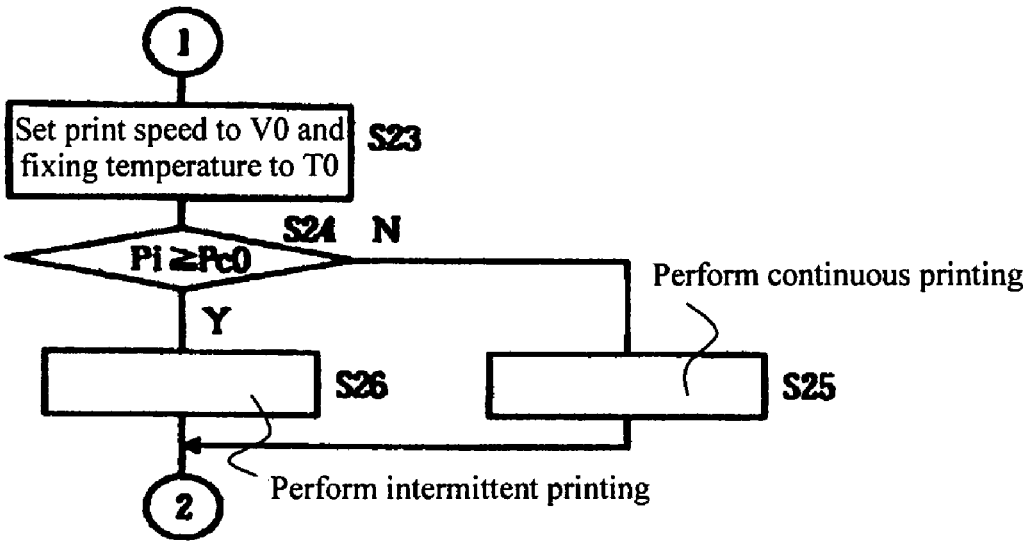
FIG. 18 is a flow chart No. 2 of the operation of the printer according to the second embodiment of the present invention.
Figure 19:
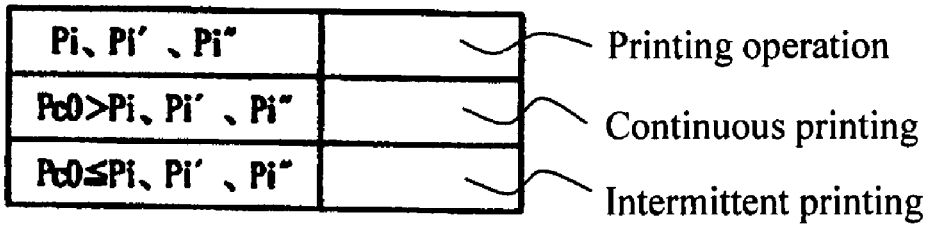
FIG. 19 is a view showing a control table of a sheet number storage unit according to the second embodiment of the present invention.

An operation of the printer according to the second embodiment will be explained next. FIG. 17 is a flow chart No. 1 of the operation of the printer according to the second embodiment of the present invention. FIG. 18 is a flow chart No. 2 of the operation of the printer according to the second embodiment of the present invention. FIG. 19 is a view showing a control table of the sheet number storage unit 86 according to the second embodiment of the present invention.

First, the print control unit 61 receives the control command and the print data from the host computer through the interface control unit 62. Upon receiving the print command from the host computer, the initial value setting section of the print control unit 61 sets the print speed V0 and the fixing temperature T0 set in advance as the initial values.

In the next step, the environmental temperature determining section (not shown) of the print control unit 61 reads the environmental temperature Te detected by the environmental thermistor 32, and compares the environmental temperature Te with the threshold value Tc1 (environmental temperature determining process). When the environmental temperature Te is lower than the threshold value Tc1, the condition setting section (not shown) of the print control unit 61 sets the print speed V to V0 and the fixing temperature T to T0.

In the next step, a sheet number determining section (not shown) of the print control unit 61 reads the number of the sheets Pi counted for the last 10 minutes from the sheet number storage unit 86, and compares the number of the sheets Pi with the threshold value Pc0 (sheet number determining process). When the number of the sheets Pi is smaller then the threshold value Pc0, the printing mode determining unit (not shown) of the print control unit 61 selects the continuous printing mode (printing mode selecting process). Accordingly, the condition setting section of the print control unit 61 sets the print speed V to V0 and the fixing temperature T to T0, thereby performing the continuous printing.

When the number of the sheets Pi is greater then the threshold value Pc0, the printing mode determining unit (not shown) of the print control unit 61 selects the intermittent printing mode as the printing mode. Accordingly, the condition setting section of the print control unit 61 sets the print speed V to V0 and the fixing temperature T to T0, thereby performing the intermittent printing.

When the environmental temperature Te is higher than the threshold value Tc1, the condition setting section of the print control unit 61 sets the print speed V to V1 and the fixing temperature T to T1.

In the next step, the environmental temperature determining section of the print control unit 61 compares the environmental temperature Te with the threshold value Tc2. When the environmental temperature Te is lower than the threshold value Tc2, the condition setting section of the print control unit 61 sets the print speed V to V1 and the fixing temperature T to T1.

In the next step, the sheet number determining section of the print control unit 61 reads the number of the sheets Pi' counted for the last 30 minutes from the sheet number storage unit 86, and compares the number of the sheets Pi' with the threshold value Pc0. When the number of the sheets Pi' is smaller then the threshold value Pc0, the printing mode determining unit of the print control unit 61 selects the continuous printing mode. Accordingly, the condition setting section of the print control unit 61 sets the print speed V to V0 and the fixing temperature T to T0, thereby performing the continuous printing.

When the number of the sheets Pi' is greater then the threshold value Pc0, the printing mode determining unit of the print control unit 61 selects the intermittent printing mode as the printing mode. Accordingly, the condition setting section of the print control unit 61 sets the print speed V to V1 and the fixing temperature T to T1, thereby performing the intermittent printing.

When the environmental temperature Te is higher than the threshold value Tc2, the condition setting section of the print control unit 61 sets the print speed V to V2 and the fixing temperature T to T2.

In the next step, the sheet number determining section of the print control unit 61 reads the number of the sheets Pi" counted for the last 60 minutes from the sheet number storage unit 86, and compares the number of the sheets Pi" with the threshold value Pc0. When the number of the sheets Pi" is smaller then the threshold value Pc0, the printing mode determining unit of the print control unit 61 selects the continuous printing mode. Accordingly, the condition setting section of the print control unit 61 sets the print speed V to V2 and the fixing temperature T to T2, thereby performing the continuous printing.

When the number of the sheets Pi" is greater then the threshold value Pc0, the printing mode determining unit of the print control unit 61 selects the intermittent printing mode as the printing mode. Accordingly, the condition setting section of the print control unit 61 sets the print speed V to V2 and the fixing temperature T to T2, thereby performing the intermittent printing. When the environmental temperature Te is high, it is difficult to discharge heat generated during the printing operation. Accordingly, it is difficult to decrease the temperature inside the printer, so that the temperature inside the printer tends to stay at a high level for a long period of time.

Afterward, the image forming section of the print control unit 61 performs the image forming process to print on a predetermined number of sheets.

In the second embodiment, the number of the printed sheets is counted. Accordingly, it is possible to estimate the temperatures inside the image forming units 22Bk, 22Y, 22M, and 22C without monitoring the temperature of toner inside the image forming units 22Bk, 22Y, 22M, and 22C with a thermistor and the likes.

The flow charts shown in FIGS. 17 and 18 will be explained next. In step S21, the print speed V0 and the fixing temperature T0 are set as the initial values. In step S22, it is determined whether the environmental temperature Te is higher than the threshold value Tc1. When the environmental temperature Te is higher than the threshold value Tc1, the process proceeds to step S27. When the environmental temperature Te is lower than the threshold value Tc1, the process proceeds to step S23.

In step S23, the print speed V is set to V0 and the fixing temperature T is set to T0. In step S24, it is determined whether the number of the sheets Pi in the last 10minutes is greater than the threshold value Pc0. When the number of the sheets Pi in the last 10 minutes is greater than the threshold value Pc0, the process proceeds to step S26. When the number of the sheets Pi in the last 10 minutes is smaller than the threshold value Pc0, the process proceeds to step S25. In step S25, the continuous printing is performed. In step S26, the intermittent printing is performed.

In step S27, the print speed V is set to V1 and the fixing temperature T is set to T1. In step S28, it is determined whether the environmental temperature Te is higher than the threshold value Tc2. When the environmental temperature Te is higher than the threshold value Tc2, the process proceeds to step S33. When the environmental temperature Te is lower than the threshold value Tc2, the process proceeds to step S29.

In step S29, the print speed V is set to V1 and the fixing temperature T is set to T1. In step S30, it is determined whether the number of the sheets Pi' in the last 30minutes is greater than the threshold value Pc0. When the number of the sheets Pi' in the last 30 minutes is greater than the threshold value Pc0, the process proceeds to step S32. When the number of the sheets Pi' in the last 30 minutes is smaller than the threshold value Pc0, the process proceeds to step S31. In step S31, the continuous printing is performed. In step S32, the intermittent printing is performed.

In step S33, the print speed V is set to V2 and the fixing temperature T is set to T2. In step S34, it is determined whether the number of the sheets Pi" in the last 60minutes is greater than the threshold value Pc0. When the number of the sheets Pi" in the last 60 minutes is greater than the threshold value Pc0, the process proceeds to step S36. When the number of the sheets Pi" in the last 60 minutes is smaller than the threshold value Pc0, the process proceeds to step S35. In step S35, the continuous printing is performed. In step S36, the intermittent printing is performed.

In step S37, it is determined whether a specified number of sheets are printed. When a specified number of sheets are printed, the process is completed. When a specified number of sheets are not printed, the process returns to step S22.

In the second embodiment, the sheet number counter 85 is disposed in the transportation path, and may be used as a recording medium detection sensor or a recording medium detection unit for detecting the sheet. Accordingly, various medium detection sensors can be used as the sheet number counter 85. In this case, various medium detection sensors detect the number of the sheets, and the print speed and the fixing temperature are set according to the environmental temperature outside the printer.

Third Embodiment

In the image forming units 22Bk, 22Y, 22M, and 22C, when the ID motor 76 starts driving, the photosensitive drums 52Bk, 52Y, 52M, and 52C; the charging rollers 40Bk, 40Y, 40M, and 40C; and the developing rollers 41Bk, 41Y, 41M, and 41C rotate. Further, the transport belt motor control unit 79 drives the transportation belt motor 80 to transport the sheet, and in the fixing device 18, the fixing motor 82 is driven to rotate the fixing roller 25 and the pressing roller 26.

In a third embodiment of the present invention, a period of powered time as an operation time of each of the ID motor 76, the transportation belt motor 80, and the fixing motor 82 is measured, thereby controlling the temperature of the image forming units 22Bk, 22Y, 22M, and 22C according to the environmental temperature outside the printer.

In the third embodiment, components similar to those in the first and second embodiments are designated by the same reference numerals, and explanations thereof are omitted. The components similar to those in the first and second embodiments provide effects same as those in the first and second embodiments.

Figure 20:
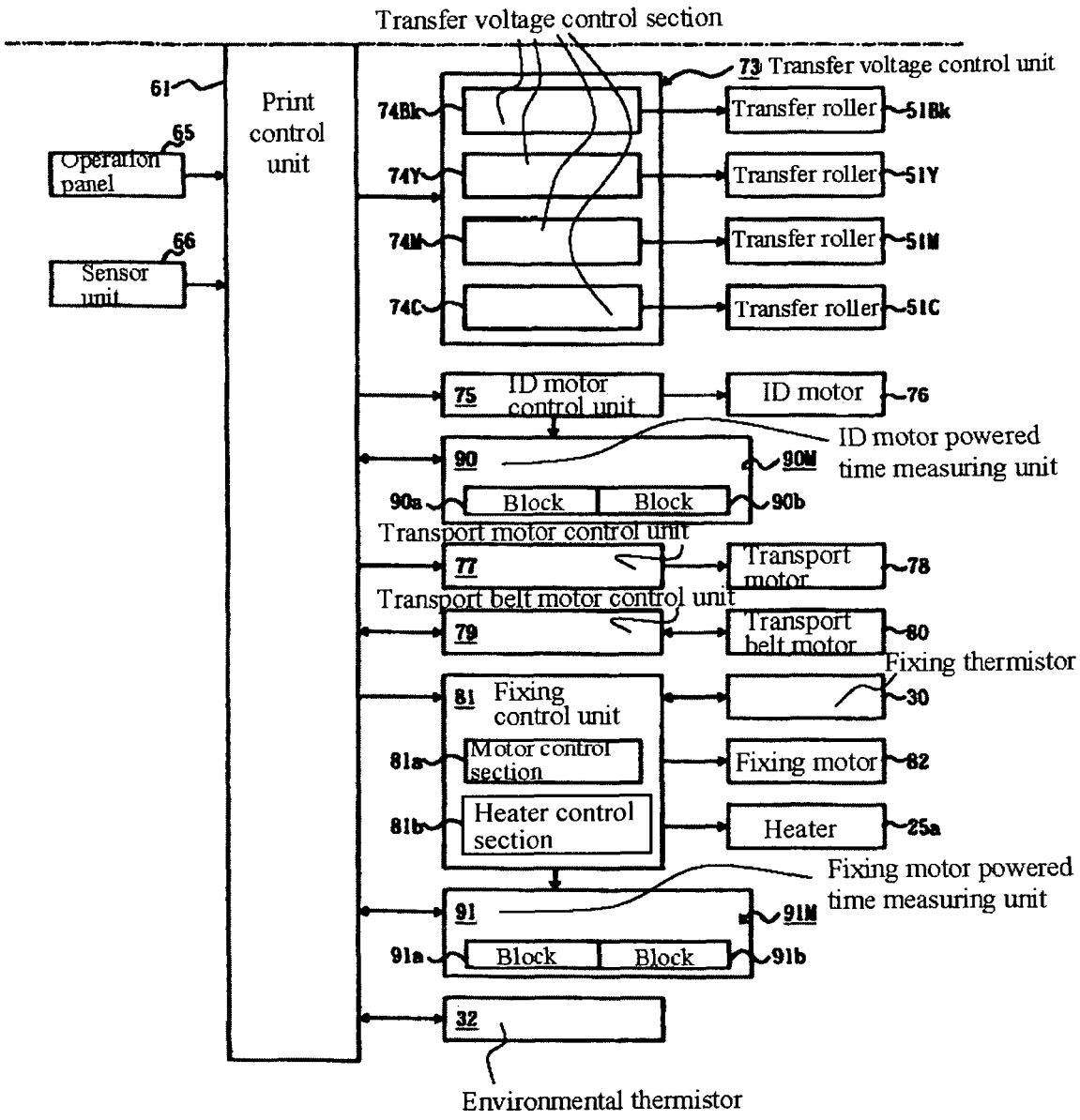
FIG. 20 is a block diagram of a control system of a printer according to a third embodiment of the present invention.

FIG. 20 is a block diagram of a control system of a printer according to the third embodiment of the present invention.

As shown in FIG. 20, the print control unit 61 is connected to an ID motor powered time measuring unit 90 as a first operation time measuring unit and a fixing motor powered time measuring unit 91 as a second operation time measuring unit. The ID motor powered time measuring unit 90 measures a period of powered time of the ID motor 76, and the fixing motor powered time measuring unit 91 measures a period of powered time of the fixing motor 82.

Further, the ID motor powered time measuring unit 90 includes a powered time storage unit 90M as a first operation time storage unit for storing a period of powered time of the ID motor 76. The fixing motor powered time measuring unit 91 includes a powered time storage unit 91M as a second operation time storage unit for storing a period of powered time of the fixing motor 82.

In the embodiment, the powered time storage unit 90M is formed of two small blocks 90*a* and 90*b*, thereby reducing a memory capacity of the powered time storage unit 90M. A powered time recording unit (not shown) of the ID motor powered time measuring unit 90 starts measuring a period of the powered time when the printer is turned on (powered time recording process). The period of the powered time thus measured is stored in a specific block 90*a* or 90*b* for a specific period of time, in the embodiment, every 30 minutes.

It is possible to store the period of the powered time for maximum 60 minutes in the powered time storage unit 90M. An information updating unit (not shown) of the ID motor powered time measuring unit 90 deletes the period of the powered time stored previously to empty one of the blocks 90*a* and 90*b* and stores the period of the powered time in the next time period (information updating process).

In the embodiment, the powered time storage unit 91M is formed of two small blocks 91*a* and 91*b*, thereby reducing a memory capacity of the powered time storage unit 91M. A powered time recording unit (not shown) of the fixing motor powered time measuring unit 91 starts measuring a period of the powered time when the printer is turned on (powered time recording process). The period of the powered time thus measured is stored in a specific block 91*a* or 91*b* for a specific period of time, i.e., in the embodiment, every 30 minutes.

It is possible to store the period of the powered time for maximum 60 minutes in the powered time storage unit 91M. An information updating unit (not shown) of the fixing motor powered time measuring unit 91 deletes the period of the powered time stored previously to empty one of the blocks 91*a* and 91*b* and stores the period of the powered time in the next time period (information updating process).

The printing mode determining unit of the print control unit 61 compares a measured time with a period of powered time measured previously to determine whether the printing mode should be the continuous printing mode or the intermittent printing mode.

In the embodiment, at every 30 minutes a period of powered time Ti1 of the ID motor 76 including a present period is replaced with a period of powered time Ti2 of the ID motor 76 measured previously, and Ti1 is reset to zero. Similarly, at every 30 minutes a period of powered time Tf1 of the fixing motor 82 including a present period is replaced with a period of powered time Tf2 of the ID motor 76 measured previously, and Tf1 is reset to zero.

Figure 21:
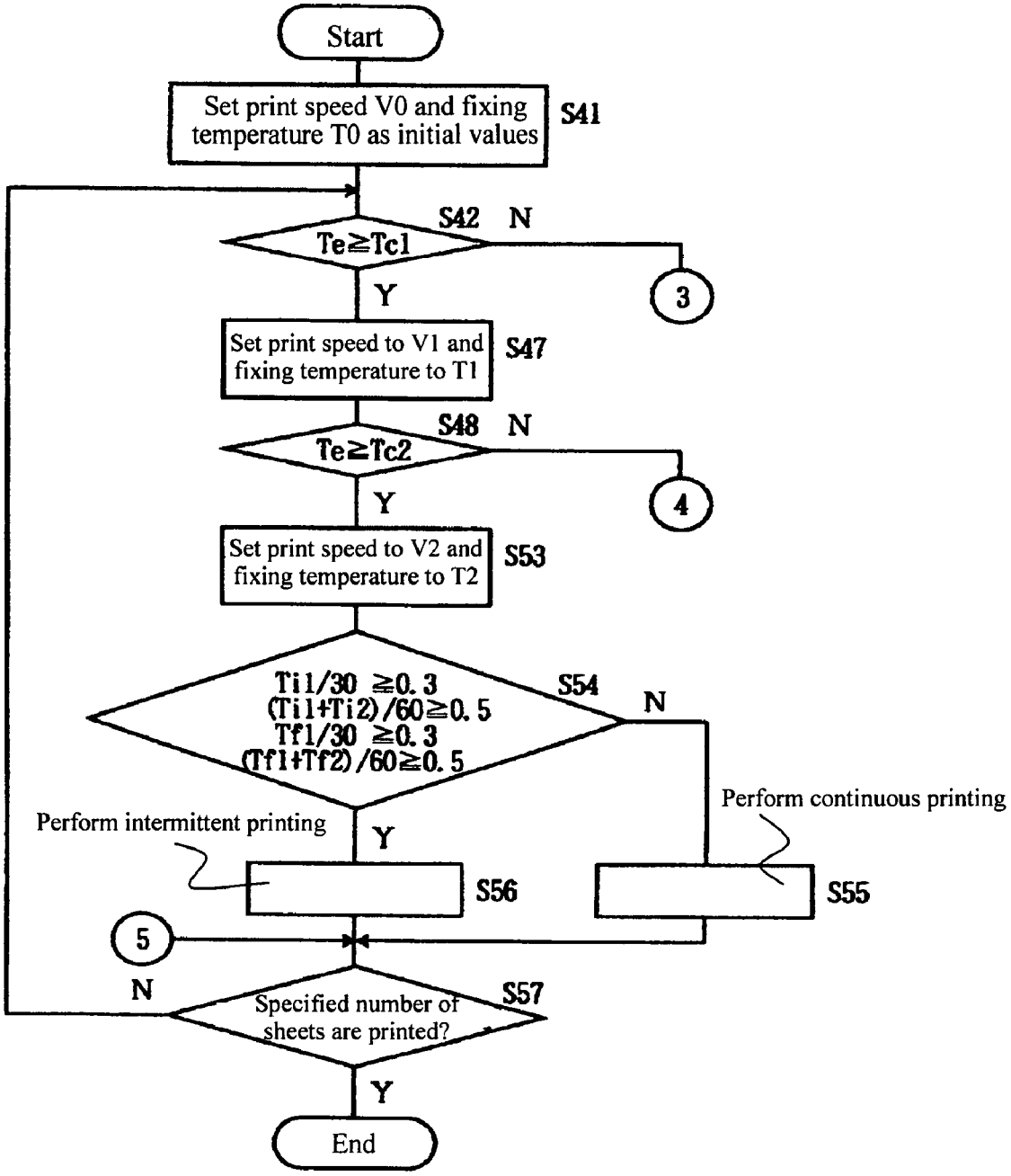
FIG. 21 is a flow chart No. 1 of an operation of the printer according to the third embodiment of the present invention.
Figure 22:
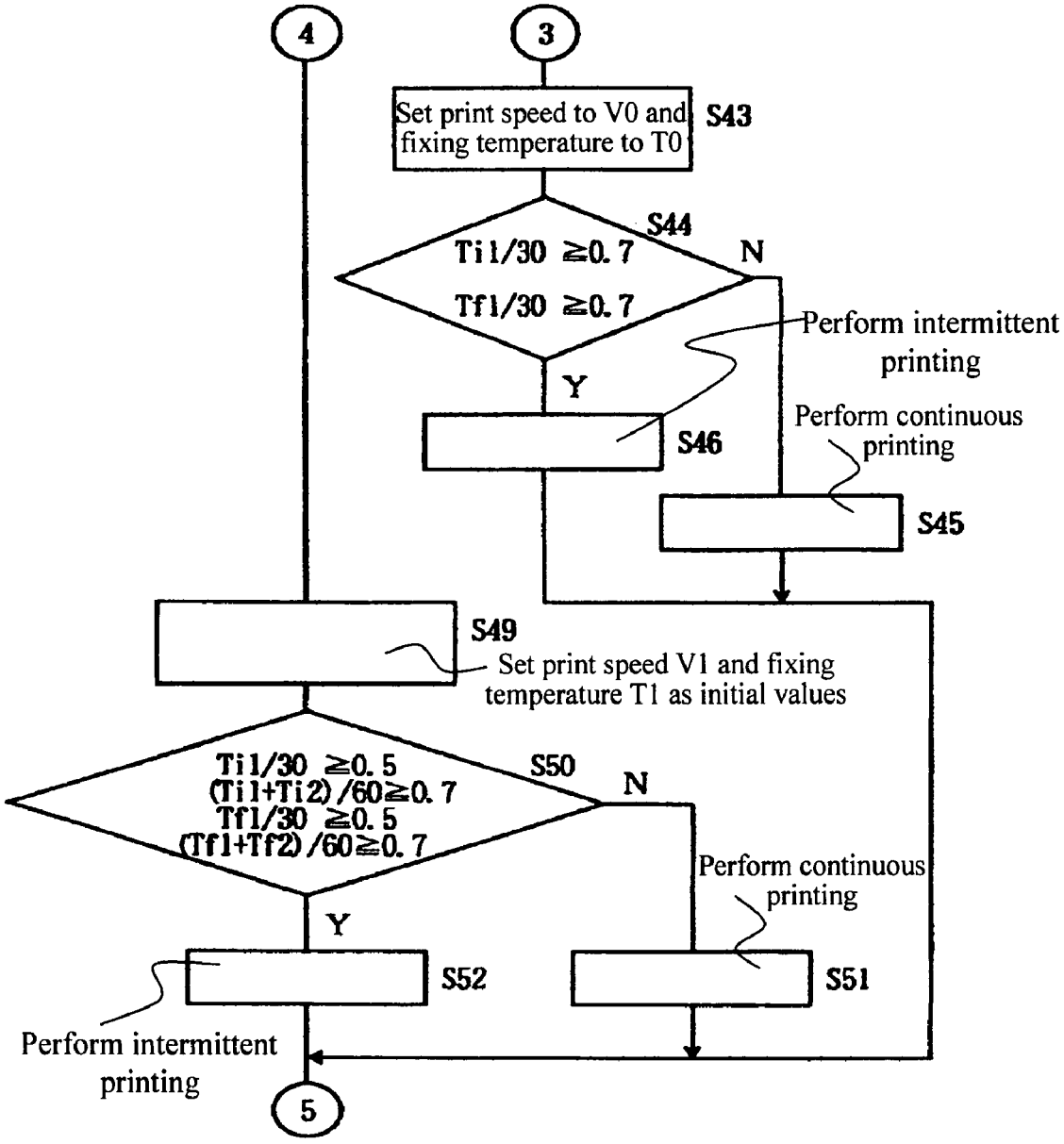
FIG. 22 is a flow chart No. 2 of the operation of the printer according to the third embodiment of the present invention.

An operation of the printer according to the third embodiment will be explained next. FIG. 21 is a flow chart No. 1 of the operation of the printer according to the third embodiment of the present invention. FIG. 22 is a flow chart No. 2 of the operation of the printer according to the third embodiment of the present invention.

First, the print control unit 61 receives the control command and the print data from the host computer through the interface control unit 62. Upon receiving the print command from the host computer, the initial value setting section of the print control unit 61 sets the print speed V0 and the fixing temperature T0 set in advance as the initial values.

In the next step, the environmental temperature determining section of the print control unit 61 reads the environmental temperature Te detected by the environmental thermistor 32, and compares the environmental temperature Te with the threshold value Tc1 (environmental temperature determining process). When the environmental temperature Te is lower than the threshold value Tc1, the condition setting section of the print control unit 61 sets the print speed V to V0 and the fixing temperature T to T0.

In the next step, a powered time determining section (not shown) of the print control unit 61 reads the period of the powered time Ti1 for 30 minutes including a present period from the powered time storage unit 90M and the period of the powered time Tf1 for 30 minutes including a present period from the powered time storage unit 91M, so that powered time ratios Ti1/30 and Tf1/30, i.e., a ratio of the period of powered time Ti1 or Tf1 relative to 30 minutes, are calculated.

In the next step, the powered time determining section determines whether the powered time ratio Ti1/30 or Tf1/30 are equal to or greater than a first threshold value, i.e., 0.7 in the embodiment. That is, it is determined whether Ti1/30≧0.7 or Tf1/30≧0.7. When the powered time ratio Ti1/30 or Tf1/30 is smaller than 0.7, the printing mode determining unit selects the continuous printing mode. Accordingly, the condition setting section sets the print speed V to V0 and the fixing temperature T to T0, thereby performing the continuous printing.

When the powered time ratio Ti1/30 or Tf1/30 is equal to or greater than 0.7, the printing mode determining unit selects the intermittent printing mode as the printing mode. Accordingly, the condition setting section sets the print speed V to V0 and the fixing temperature T to T0, thereby performing the intermittent printing.

When the environmental temperature Te is higher than the threshold value Tc1, the condition setting section of the print control unit 61 sets the print speed V to V1 and the fixing temperature T to T1.

In the next step, the environmental temperature determining section of the print control unit 61 compares the environmental temperature Te with the threshold value Tc2. When the environmental temperature Te is lower than the threshold value Tc2, the condition setting section of the print control unit 61 sets the print speed V to V1 and the fixing temperature T to T1.

In the next step, the powered time determining section of the print control unit 61 reads the period of the powered time Ti1 for 30 minutes including a present period and the period of the powered time Ti2 for last 30 minutes from the powered time storage unit 90M. The powered time determining section also reads the period of the powered time Tf1 for 30 minutes including a present period and the period of the powered time Tf2 for last 30 minutes from the powered time storage unit 91M. Then, the powered time determining section calculates powered time ratios (Ti1+Ti2)/60 and (Tf1+Tf2)/60, i.e., a ratio of a sum of the period of powered time Ti1 or Tf1 and the period of powered time Ti2 or Tf2 for last 30 minutes relative to 60 minutes, i.e., a sum of 30 minutes including a present period and last 30 minutes.

In the next step, the powered time determining section determines whether the powered time ratio Ti1/30 or Tf1/30 is equal to or greater than a second threshold value, i.e., 0.5 in the embodiment. That is, it is determined whether Ti1/30≧0.5 or Tf1/30≧0.5. Further, the powered time determining section determines whether the powered time ratio (Ti1+Ti2)/60 or (Tf1+Tf2)/60 is equal to or greater than the first threshold value, 0.7 in the embodiment. That is, it is determined whether (Ti1+Ti2)/60≧0.7 or (Tf1+Tf2)/60≧0.7.

When the powered time ratio Ti1/30 or Tf1/30 is smaller than 0.5 or the powered time ratio (Ti1+Ti2)/60 or (Tf1+Tf2)/60 is smaller than 0.7, the printing mode determining unit selects the continuous printing mode. Accordingly, the condition setting section sets the print speed V to V1 and the fixing temperature T to T1, thereby performing the continuous printing.

When the powered time ratio Ti1/30 or Tf1/30 is equal to or greater than 0.5 or the powered time ratio (Ti1+Ti2)/60 or (Tf1+Tf2)/60 is equal to or greater than 0.7, the printing mode determining unit selects the intermittent printing mode as the printing mode. Accordingly, the condition setting section sets the print speed V to V1 and the fixing temperature T to T1, thereby performing the intermittent printing.

When the environmental temperature Te is higher than the threshold value Tc2, the condition setting section of the print control unit 61 sets the print speed V to V2 and the fixing temperature T to T2.

In the next step, the powered time determining section determines whether the powered time ratio Ti1/30 or Tf1/30 is equal to or greater than a third threshold value, i.e., 0.3 in the embodiment. That is, it is determined whether Ti1/30≧0.3 or Tf1/30≧0.3. Further, the powered time determining section determines whether the powered time ratio (Ti1+Ti2)/60 or (Tf1+Tf2)/60 is equal to or greater than the second threshold value, 0.5 in the embodiment. That is, it is determined whether (Ti1+Ti2)/60≧0.5 or (Tf1+Tf2)/60≧0.5.

When the powered time ratio Ti1/30 or Tf1/30 is smaller than 0.3 or the powered time ratio (Ti1+Ti2)/60 or (Tf1+Tf2)/60 is smaller than 0.5, the printing mode determining unit selects the continuous printing mode. Accordingly, the condition setting section sets the print speed V to V2 and the fixing temperature T to T2, thereby performing the continuous printing.

When the powered time ratio Ti1/30 or Tf1/30 is equal to or greater than 0.3 or the powered time ratio (Ti1+Ti2)/60 or (Tf1+Tf2)/60 is equal to or greater than 0.5, the printing mode determining unit selects the intermittent printing mode as the printing mode. Accordingly, the condition setting section sets the print speed V to v2 and the fixing temperature T to T2, thereby performing the intermittent printing.

When the environmental temperature Te is high, it is difficult to discharge heat generated during the printing operation. Accordingly, it is difficult to decrease the temperature inside the printer, so that the temperature inside the printer tends to stay at a high level for a long period of time.

Afterward, the image forming section of the print control unit 61 performs the image forming process to print on a predetermined number of sheets.

In the third embodiment, the period of the powered time is measured. Accordingly, it is possible to estimate the temperatures inside the image forming units 22Bk, 22Y, 22M, and 22C without monitoring toner inside the image forming units 22Bk, 22Y, 22M, and 22C with thermistors and the likes.

The flow charts shown in FIGS. 21 and 22 will be explained next. In step S41, the print speed V0 and the fixing temperature T0 are set as the initial values. In step S42, it is determined whether the environmental temperature Te is higher than the threshold value Tc1. When the environmental temperature Te is higher than the threshold value Tc1, the process proceeds to step S47. When the environmental temperature Te is lower than the threshold value Tc1, the process proceeds to step S43.

In step S43, the print speed V is set to V0 and the fixing temperature T is set to T0. In step S44, it is determined whether the powered time ratio Ti1/30 or Tf1/30 is equal to or greater than the first threshold value of 0.7. When the powered time ratio Ti1/30 or Tf1/30 is equal to or greater than the first threshold value of 0.7, the process proceeds to step S46. When the powered time ratio Ti1/30 or Tf1/30 is not equal to or greater than the first threshold value of 0.7, the process proceeds to step S45. In step S45, the continuous printing is performed. In step S46, the intermittent printing is performed.

In step S47, the print speed V is set to V1 and the fixing temperature T is set to Ti. In step S48, it is determined whether the environmental temperature Te is higher than the threshold value Tc2. When the environmental temperature Te is higher than the threshold value Tc2, the process proceeds to step S53. When the environmental temperature Te is lower than the threshold value Tc2, the process proceeds to step S49.

In step S49, the print speed V is set to V1 and the fixing temperature T is set to T1. In step S50, it is determined whether the powered time ratio Ti1/30 or Tf1/30 is equal to or greater than the second threshold value of 0.5 or the powered time ratio (Ti1+Ti2)/60 or (Tf1+Tf2)/60 is equal to or greater than the first threshold value of 0.7.

When the powered time ratio Ti1/30 or Tf1/30 is equal to or greater than the second threshold value of 0.5 or the powered time ratio (Ti1+Ti2)/60 or (Tf1+Tf2)/60 is equal to or greater than the first threshold value of 0.7, the process proceeds to step S52. When the powered time ratio Ti1/30 or Tf1/30 is not equal to or greater than the second threshold value of 0.5 or the powered time ratio (Ti1+Ti2)/60 or (Tf1+Tf2)/60 is not equal to or greater than the first threshold value of 0.7, the process proceeds to step S51. In step S51, the continuous printing is performed. In step S52, the intermittent printing is performed.

In step S53, the print speed V is set to V2 and the fixing temperature T is set to T2. In step S54, it is determined whether the powered time ratio Ti1/30 or Tf1/30 is equal to or greater than the third threshold value of 0.3 or the powered time ratio (Ti1+Ti2)/60 or (Tf1+Tf2)/60 is equal to or greater than the second threshold value of 0.5.

When the powered time ratio Ti1/30 or Tf1/30 is equal to or greater than the third threshold value of 0.3 or the powered time ratio (Ti1+Ti2)/60 or (Tf1+Tf2)/60 is equal to or greater than the second threshold value of 0.5, the process proceeds to step S56. When the powered time ratio Ti1/30 or Tf1/30 is not equal to or greater than the third threshold value of 0.3 or the powered time ratio (Ti1+Ti2)/60 or (Tf1+Tf2)/60 is not equal to or greater than the second threshold value of 0.5, the process proceeds to step S55. In step S55, the continuous printing is performed. In step S56, the intermittent printing is performed.

In step S57, it is determined whether a specified number of sheets are printed. When a specified number of sheets are printed, the process is completed. When a specified number of sheets are not printed, the process returns to step S42.

In the third embodiment, the periods of the powered time of the ID motor 76 and the fixing motor 82 are measured. Alternatively, an experiment may be conducted for establishing a relationship between the periods of the powered time of the ID motor 76 and the fixing motor 82 and the periods of the powered time of the transportation motor 78 and the transportation belt motor 80. From results of the experiment, it is possible to estimate the temperature inside the printer according to the periods of the powered time of the transportation motor 78 and the transportation belt motor 80. In this case, the print speed and the fixing temperature are set according to the environmental temperature outside the printer.

In the third embodiment, the periods of the powered time of the ID motor 76 and the fixing motor 82 are measured. In general, it takes a stabilization time until a motor is driven stably. Accordingly, it is possible to estimate the temperature inside the printer through a control according to a change in a current supplied to the ID motor 76 and the fixing motor 82. For example, a stepping motor is configured to drive through a pulse sent from a motor control unit. Accordingly, it is possible to estimate the temperature inside the printer based on the number of pulses per unit time.

In the embodiments described above, toner is formed of two non-magnetic components, and generates heat through friction upon being charged. When toner is formed of a magnetic component or two components, toner generates heat accompanied with rotation of a developing roller when toner reaches a photosensitive drum.

In the embodiments described above, the printer is of an LED tandem type, and may be a printer of a laser type or an intermediate transfer type.

In the embodiments described above, the environmental thermistor 32 is disposed inside the external member 35 as the environmental temperature detection unit, and may be disposed outside the external member 35. An external device such as a personal computer and an infrared sensor may be provided for sending the environmental temperature as temperature information to the printer. In this case, the print control unit 61 includes an environmental temperature detection unit as an external temperature detection unit.

In the embodiments described above, the printer is explained as the image forming apparatus. The image forming apparatus may include a copier, a facsimile, a multifunction device, and the like.

The disclosure of Japanese Patent Application No. 2006-066213, filed on Mar. 10, 2006, is incorporated in the application.

While the invention has been explained with reference to the specific embodiments of the invention, the explanation is illustrative and the invention is limited only by the appended claims.

What is claimed is:

1. An image forming apparatus comprising:

an image supporting member;

a developer supporting member for attaching developer to the image supporting member to form a developer image;

a transfer unit for transferring the developer image to a recording medium;

a fixing unit for fixing the developer image to the recording medium at a fixing temperature;

an external temperature detection unit for detecting an environmental temperature outside the image forming apparatus;

a sheet number storage unit for storing a number of the recording media;

an ID motor powered time measuring unit for measuring a period of powered time of an ID motor;

a fixing motor powered time measuring unit for measuring a period of powered time of a fixing motor; and a control unit for changing a target temperature according to the environmental temperature and the number of the recording media so that the fixing temperature of the fixing unit becomes the target temperature, said control unit setting the fixing temperature according to the environmental temperature, the period of powered time of the ID motor, and the period of powered time of the fixing motor.

2. The image forming apparatus according to claim 1, further comprising a medium transportation unit for transporting the recording medium, said control unit being arranged to set a printing speed according to the environmental temperature and control the medium transportation unit according to the printing speed.

3. The image forming apparatus according to claim 1, further comprising an external member having an air hole, said external temperature detection unit being disposed adjacent to the air hole.

4. The image forming apparatus according to claim 2, further comprising an external member having an air hole, said external temperature detection unit being disposed adjacent to the air hole.

5. The image forming apparatus according to claim 1, wherein said external temperature detection unit is disposed below the fixing unit.

6. The image forming apparatus according to claim 1, wherein said external temperature detection unit is disposed at an upstream side relative to the fixing unit in a direction that the recording medium is transported.

7. The image forming apparatus according to claim 1, further comprising a first driving unit for driving at least one of the image supporting member, the developer supporting member, and the transfer unit, said control unit decreasing a first driving speed of the first driving unit as the environmental temperature increases.

8. The image forming apparatus according to claim 1, wherein said control unit decreases the fixing temperature as the environmental temperature increases.

9. The image forming apparatus according to claim 1, further comprising an internal temperature detection unit for detecting an internal temperature inside the image forming apparatus and a first driving unit for driving at least one of the image supporting member, the developer supporting member, and the transfer unit, said control unit setting a first driving speed of the first driving unit according to the environmental temperature and the internal temperature.

10. The image forming apparatus according to claim 9, wherein said internal temperature detection unit detects a surface temperature of the image supporting member.

11. The image forming apparatus according to claim 9, wherein said internal temperature detection unit detects a surface temperature of a transfer member arranged to face the image supporting member.

12. The image forming apparatus according to claim 1, further comprising a sheet number counting unit for counting the number of the recording media to be printed and a first driving unit for driving at least one of the image supporting member, the developer supporting member, and the transfer unit, said control unit setting a first driving speed of the first driving unit according to the number of the recording media thus stored.

13. The image forming apparatus according to claim 12, wherein said sheet number counting unit is disposed in a transportation path for counting the number of the recording media passing through the transportation path.

14. The image forming apparatus according to claim 1, further comprising an operation time measuring unit for measuring an operation time of the image forming apparatus and a first driving unit for driving at least one of the image supporting member, the developer supporting member, and the transfer unit, said control unit further storing the operation time thus measured in an operation time storage unit and setting a first driving speed of the first driving unit according to the operation time thus stored.

15. The image forming apparatus according to claim 1, wherein said sheet number storage unit is arranged to store the number of the recording media to be printed within a specific period of time.

16. The image forming apparatus according to claim 9, wherein said internal temperature detection unit is disposed near the fixing unit.

17. The image forming apparatus according to claim 9, wherein said internal temperature detection unit is disposed in a drum unit near the fixing unit.

18. The image forming apparatus according to claim 9, wherein said internal temperature detection unit is disposed in a drum unit at a most furthest position from the fixing unit.

19. The image forming apparatus according to claim 1, wherein said control unit is arranged to determine whether a continuous printing operation or an intermittent printing operation is performed according to the environmental temperature and the number of the recording media.

20. An image forming apparatus comprising:

an image supporting member;

a developer supporting member for attaching developer to the image supporting member to form a developer image;

a transfer unit for transferring the developer image to a recording medium;

a fixing unit for fixing the developer image to the recording medium at a fixing temperature;

an external temperature detection unit for detecting an environmental temperature outside the image forming appparatus;

a sheet number storage unit for storing a number of the recording media;

an ID motor powered time measuring unit for measuring a period of powered time of an ID motor;

a fixing motor powered time measuring unit for measuring a period of powered time of a fixing motor; and a control unit for changing a target temperature according to the environmental temperature and the number of the recording media so that the fixing temperature of the fixing unit becomes the target temperature, said control unit determining whether a continuous printing operation or an intermittent printing operation is performed according to the environmental temperature, the period of powered time of the ID motor, and the period of powered time of the fixing motor.

* * * * *